US007113142B2

(12) United States Patent
McCarville et al.

(10) Patent No.: US 7,113,142 B2
(45) Date of Patent: Sep. 26, 2006

(54) DESIGN AND FABRICATION METHODOLOGY FOR A PHASED ARRAY ANTENNA WITH INTEGRATED FEED STRUCTURE-CONFORMAL LOAD-BEARING CONCEPT

(75) Inventors: Douglas A McCarville, Auburn, WA (US); Gerald F Herndon, Redmond, WA (US); Joseph A Marshall, IV, Lake Forest Park, WA (US); Robert G Vos, Auburn, WA (US); David L Banks, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 27 days.

(21) Appl. No.: 10/970,711

(22) Filed: Oct. 21, 2004

(65) Prior Publication Data

US 2006/0097946 A1 May 11, 2006

(51) Int. Cl.
*H01Q 21/26* (2006.01)
*H01Q 1/40* (2006.01)

(52) U.S. Cl. ..... 343/797; 343/873; 343/700 MS

(58) Field of Classification Search ..... 343/797, 343/795, 705, 708, 700 MS, 873
See application file for complete search history.

(56) References Cited

U.S. PATENT DOCUMENTS 4,686,536 A * 8/1987 Allcock ..... 343/700 MS
5,184,141 A 2/1993 Connolly et al.
5,786,792 A * 7/1998 Bellus et al. ..... 343/770
5,845,391 A * 12/1998 Bellus et al. ..... 29/600
6,359,596 B1 * 3/2002 Claiborne ..... 343/795
6,424,313 B1 7/2002 Navarro et al.
2004/0151876 A1 8/2004 Tanielian
2005/0078046 A1 * 4/2005 Theobold et al. ..... 343/797

OTHER PUBLICATIONS

Wallace, Jack; Redd, Harold; and Furlow, Robert; "Low Cost MMIC DBS Chip Sets For Phased Array Applications," IEEE, 1999, 4 pages.

* cited by examiner

*Primary Examiner*—Hoang V. Nguyen
(74) *Attorney, Agent, or Firm*—Harness Dickey & Pierce P.L.C.

(57) ABSTRACT

A conformal, load bearing, phased array antenna system having a plurality of adjacently positioned antenna aperture sections that collectively form a single, enlarged antenna aperture. The aperture sections are each formed by intersecting wall panels that form a honeycomb-like core having a plurality of electromagnetic radiating elements embedded in the wall panels that form the core. The aperture wall panels are assembled onto a single, multi-faceted back skin, bonded thereto, and then machined to produce a desired surface contour. A radome formed by a single piece of composite material is then bonded to the contoured surface. Antenna electronics printed wiring boards are also bonded to an opposite side of the back skin. The contour is selected to match a mold line of a surface into which the antenna system is installed. The antenna is able to form an integral, load bearing portion of the structure into which it is installed.

24 Claims, 27 Drawing Sheets

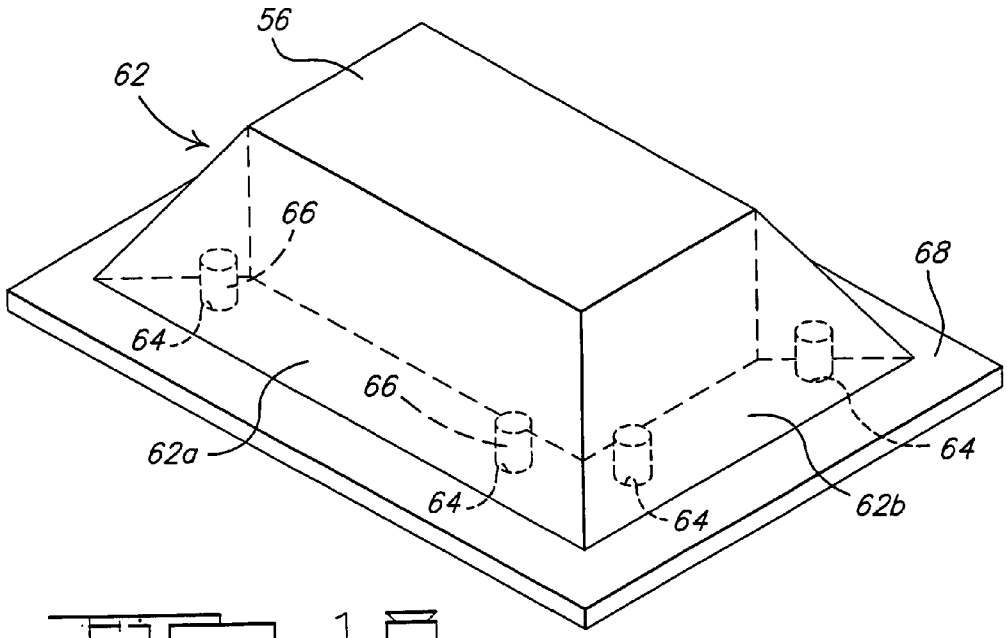
FIG. 18.
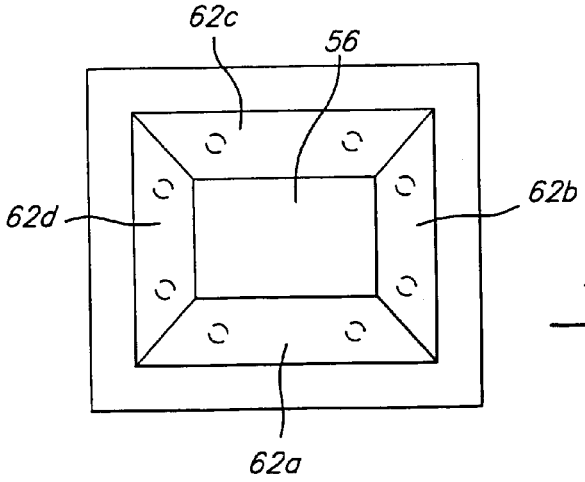
FIG. 19.
FIG. 20.
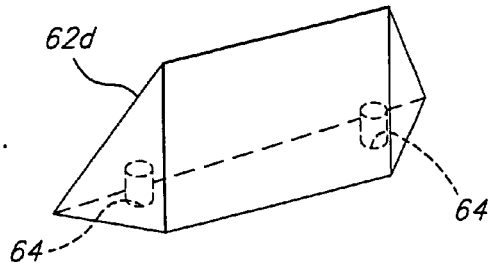

| | Shear | Flatwise | Bending | Compression |
|---|---|---|---|---|
| For Antenna 10 Honeycomb Like Core Of 11.7 Lbs./Sq. Ft. | 557 lb | 698 lb | 1015 lb | 3100 lb |
| Conventional 12 Lbs./Sq. Ft. HRP® Core | 531 lb | 625 lb | 1000 lb | 2080 lb |

FIG. 39.
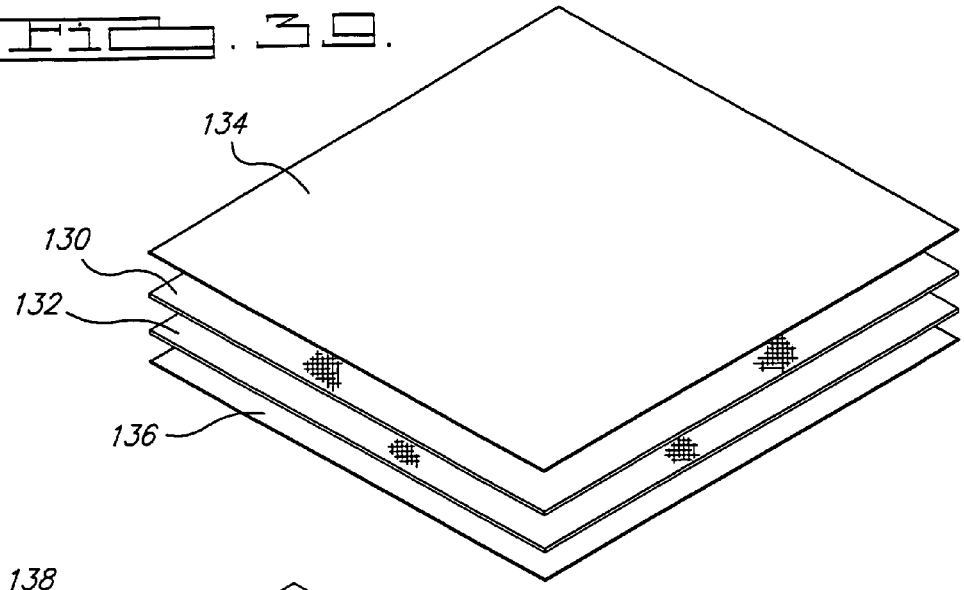
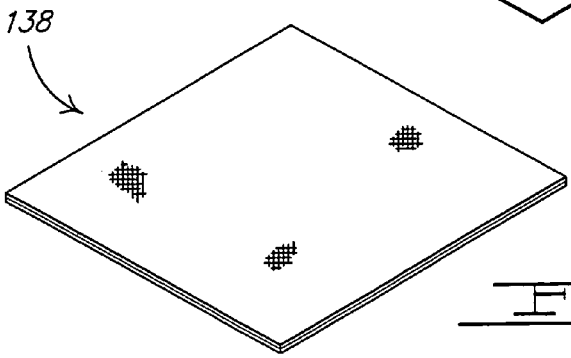
FIG. 40.
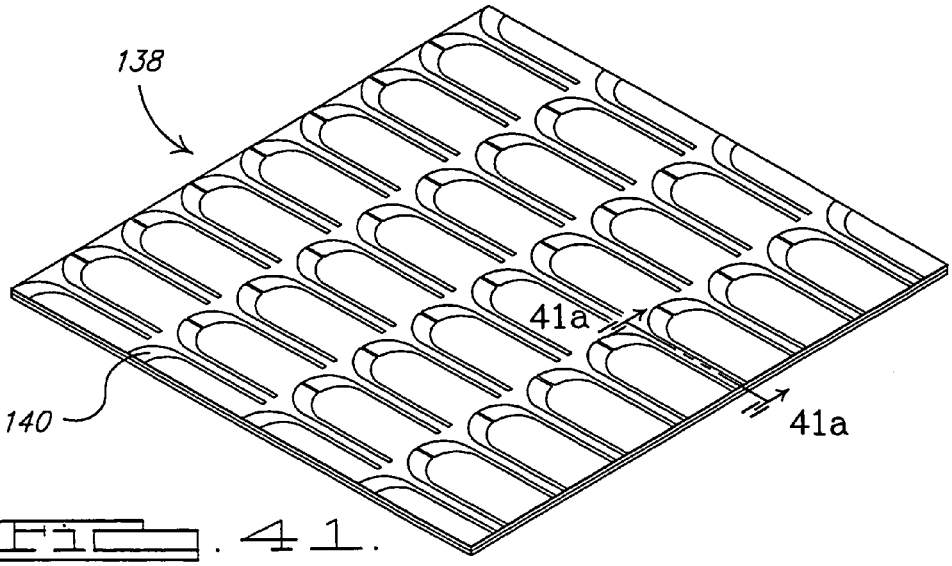
FIG. 41.

DESIGN AND FABRICATION METHODOLOGY FOR A PHASED ARRAY ANTENNA WITH INTEGRATED FEED STRUCTURE-CONFORMAL LOAD-BEARING CONCEPT

STATEMENT OF GOVERNMENT RIGHTS

This invention was made with Government support under Contract Number F33615-97-2-3220 awarded by the United States Air Force. The U.S. Government has certain rights in this invention.

CROSS REFERENCE TO RELATED APPLICATIONS

This application includes subject matter related to the following U.S. applications filed concurrently with, the present application: Ser. No. 10/970,702 Ser. No. 10/970 703 now U.S. Pat. No. 7,046,209 and Ser. No. 10/970,710 all of which are incorporated by reference into the present application.

FIELD OF THE INVENTION

The present invention relates to antenna systems, and more particularly to a conformal antenna system having a plurality of antenna apertures formed adjacent one another, and having a desired contour. The antenna system can be used as a structural, load-bearing portion of a mobile platform and constructed to match an outer mold line of the area of the mobile platform into which the antenna system is integrated.

BACKGROUND OF THE INVENTION

Present day mobile platforms, such as aircraft (manned and unmanned), spacecraft and even land vehicles, often require the use of an antenna aperture for transmitting and receiving electromagnetic wave signals. The antenna aperture is often provided in the form of a phased array antenna aperture having a plurality of antenna elements arranged in an X-Y grid-like arrangement on the mobile platform. Typically there is weight that is added to the mobile platform by the various components on which the radiating elements of the antenna are mounted. Often these components comprise aluminum blocks or other like substructures that add "parasitic" weight to the overall antenna aperture, but otherwise perform no function other than as a support structure for a portion of the antenna aperture. By the term "parasitic" it is meant weight that is associated with components of the antenna that are not directly necessary for transmitting or receiving operations.

Providing an antenna array that is able to form a load bearing structure for a portion of a mobile platform would provide important advantages. In particular, the number and nature of sensor functions capable of being implemented on the mobile platform could be increased significantly over conventional electronic antenna and sensor systems that require physical space within the mobile platform. Integrating the antenna into the structure of the mobile platform also eliminates the adverse effect on aerodynamics that is often produced when an antenna aperture is mounted on an exterior surface of a mobile platform. This would also eliminate the parasitic weight that would otherwise be present if the antenna aperture was formed as a distinct, independent component that required mounting on an interior or exterior surface of the mobile platform.

With various mobile platforms, there is also a need to provide an antenna array having one surface with a curvature that matches an outer mold line of the structure into which the antenna system is to be integrated. For example, on aircraft and spacecraft, where it would be desired to integrate an antenna system onto an area having a curving contour, such as a wing, it would be necessary to form the antenna system with one surface (i.e., a radome) having a curvature that will match the outer mold line of the structure at the area where the antenna system is to be integrated. This is often necessary for preserving the aerodynamic qualities of the mobile platform. This requirement becomes especially challenging when the antenna system is required to incorporate a large number of antenna elements that must be integrated into an area having a curving or otherwise non-linear contour.

SUMMARY OF THE INVENTION

The present invention is directed to an antenna aperture having a construction making it suitable to be integrated as a structural, load bearing portion of another structure. In one preferred form the antenna aperture of the present invention is constructed to form a load bearing portion of a mobile platform, and more particularly a curving portion of a wing, fuselage or door of an airborne mobile platform.

The antenna aperture of the present invention forms a honeycomb-like grid of antenna elements that are sandwiched between two panels. This construction provides the structural strength needed when the antenna aperture is integrated into a structural portion of a mobile platform or other structure. The antenna aperture can be manufactured, and scaled, to suit a variety of antenna and/or sensor applications.

In one preferred form the antenna aperture comprises a phased array antenna aperture having a honeycomb-like wall structure. The honeycomb-like wall structure has an X-Y grid-like arrangement of dipole radiating elements. The antenna aperture does not require any metallic, parasitic supporting structures that would ordinarily be employed as support substrates for the radiating elements, and thus avoids the parasitic weight that such components typically add to an antenna aperture.

In one preferred method, electromagnetic radiating elements are formed on a substrate. The substrate is sandwiched between two layers of composite prepreg material to make the assembly rigid and structural when cured. The cured laminated sheet is cut into strips with each strip having a plurality of the embedded electromagnetic radiating elements corresponding to the number of elements in a row or column of a phased array that will be made from the strips.

The strips are then placed in a tool or fixture and adhered together to form a honeycomb wall structure. In one preferred implementation slots are cut at various areas along each of the strips to better enable interconnection of the strips at various points along each strip. In another preferred implementation portions of each strip are cut away such that edge portions of each electromagnetic radiating element form "teeth" that even better facilitate electrical connection of the radiating elements with external antenna electronics components.

A plurality of antenna apertures can be formed substantially simultaneously on a single tool. The tool employs a plurality of spaced apart, precisely located metallic blocks that form a series of perpendicularly extending slots to form an X-Y grid. A first subplurality of strips of radiating elements are inserted into the tool and adhesive is used to temporarily hold the strips in a grid-like arrangement. A second subplurality of strips of radiating elements are then assembled onto the tool on top of the first subplurality of strips of radiating elements. The second plurality of strips of radiating elements are likewise arranged in a X-Y grid like fashion with adhesive used to temporarily hold the elements in the grid-like arrangement. The assembled strips are then cured in an oven or autoclave. The cured strips are readily separated and assembled to form arrays of ordered antenna apertures that can function as a phased array.

In one preferred implementation the wall portions are each formed such that the radiating elements have feed portions that each form teeth. The wall portions are further constructed such that each tooth has its perimeter walls coated with a metallic plating to electrically isolate each tooth. When the wall sections are assembled to a back skin, the teeth project through the back skin and can be machined down to present flat electrical contact pads that are generally flush with a surface of the back skin. The electrical isolation provided by the metallic plating around each tooth eliminates the need to use a back skin material having high electrical isolation properties. Thus, the back skin can be stronger and ligher.

In an alternative preferred embodiment a multi-faceted, conformal, phased array antenna system is provided that includes a plurality of independent antenna apertures formed adjacent one another on a common back skin. The antenna system further includes one surface that is shaped so as to provide a contour that matches an outer mold line of a structure that the antenna system is to be integrated into. This embodiment comprises a back skin having a plurality of distinct, planar segments. A separate antenna electronics printed wiring board is secured to one side of each of the planar segments of the back skin. Independent wall portions of each of the antenna apertures are constructed on the opposite surface of each planar segment to form a plurality of adjacent, honeycomb-like aperture sections. An upper surface of each aperture section is then machined such that the plurality of aperture sections together have a desired curvature or contour. A single piece, pre-formed radome is then secured over the contoured surfaces of the aperture sections. Antenna apertures of widely varying dimensions and shapes can thus be constructed from a plurality of independent antenna aperture sections placed adjacent one another on a common back skin. The conformed antenna system is especially well suited for applications involving large numbers of antenna radiating elements that must be integrated into a non-linear mold line of a structure, for example a wing, fuselage, door or other area of an aircraft or spacecraft.

The features, functions, and advantages can be achieved independently in various embodiments of the present inventions or may be combined in yet other embodiments.

BRIEF DESCRIPTION OF THE DRAWINGS

The present invention will become more fully understood from the detailed description and the accompanying drawings, wherein:

FIG. 18 is a perspective view of the subassembly of FIG. 16 placed within a compaction tool 62 for compacting;

FIG. 19 is a top view of the assembly of FIG. 18;

FIG. 20 is a perspective view of one of the sections of the tool shown in FIG. 18;

FIG. 39 shows an alternative preferred construction for the wall sections that employs prepreg fabric layers sandwiched between metallic foil layers;

FIG. 40 illustrates the layers of material shown in FIG. 39 formed as a rigid sheet;

FIG. 41 illustrates one surface of the sheet shown in FIG. 40 having electromagnetic radiating elements;

DETAILED DESCRIPTION OF THE PREFERRED EMBODIMENTS

The following description of the preferred embodiment(s) is merely exemplary in nature and is in no way intended to limit the invention, its application, or uses.

Figure 1:
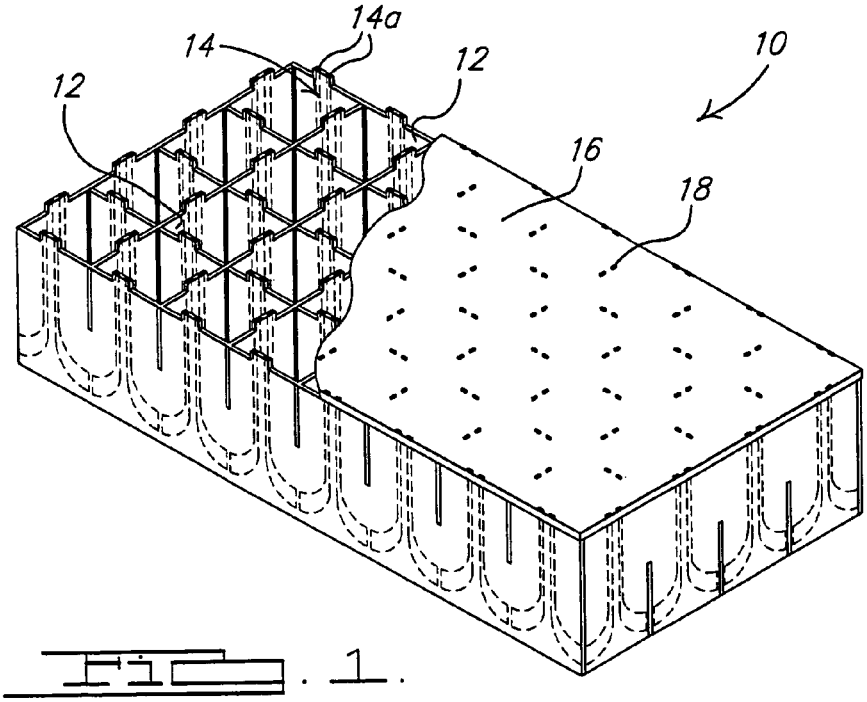
FIG. 1 is a perspective view of an antenna aperture in accordance with a preferred embodiment of the present invention.

Referring to FIG. 1, there is shown an antenna aperture 10 in accordance with a preferred embodiment of the present invention. The antenna aperture 10 essentially forms a load bearing honeycomb-like structure that can be readily integrated into composite structural portions of mobile platforms without affecting the overall strength of the structural portion, and without adding significant additional weight beyond what would be present with a conventional honeycomb core, sandwich-like construction technique that does not incorporate an antenna capability.

The aperture 10 includes a plurality of wall sections 12 interconnected to form a honeycomb or grid-like core section. Each wall section 12 includes a plurality of electromagnetic radiating elements 14 embedded therein. While FIG. 1 illustrates an X-Y grid-like (i.e., honeycomb-like) arrangement presenting generally square shaped openings, other grid arrangements are possible. For example, a honeycomb or grid-like core structure having hexagonally shaped openings can also be formed. Accordingly, the perpendicular layout of the wall sections 12 that form antenna aperture 10 is intended merely to show one preferred grid-like layout for the radiating elements 14. The type of grid selected and the overall size of the antenna aperture 10 will depend on the needs of a particular application with which the aperture 10 is to be used.

The preferred antenna aperture 10 does not require the use of metallic substrates for supporting the radiating elements 14. The antenna aperture 10 therefore does not suffer as severe a parasitic weight penalty. The antenna aperture 10 is a lightweight structure making it especially well suited for aerospace applications.

The preferred aperture 10 provides sufficient structural strength to act as a load bearing structure. For example, in mobile platform applications, the antenna aperture 10 can be used as a primary structural component in an aircraft, spacecraft or rotorcraft. Other possible applications may be with ships or land vehicles. Since the antenna aperture 10 can be integrated into the structure of the mobile platform, it does not negatively impact the aerodynamics of the mobile platform as severely as would be the case with an antenna aperture that is required to be mounted on an external surface of an otherwise highly aerodynamic, high speed mobile platform.

With further reference to FIG. 1, the antenna aperture 10 further includes a back skin 16, a portion of which has been cut away to better reveal the grid-like arrangement of wall sections 12. The back skin 16 has openings 18 which allow "teeth" 14*a* of each electromagnetic radiating component 14 to project to better enable electrical connection of the radiating elements 14 with other electronic components.

Construction of Wall Sections

Figure 2:
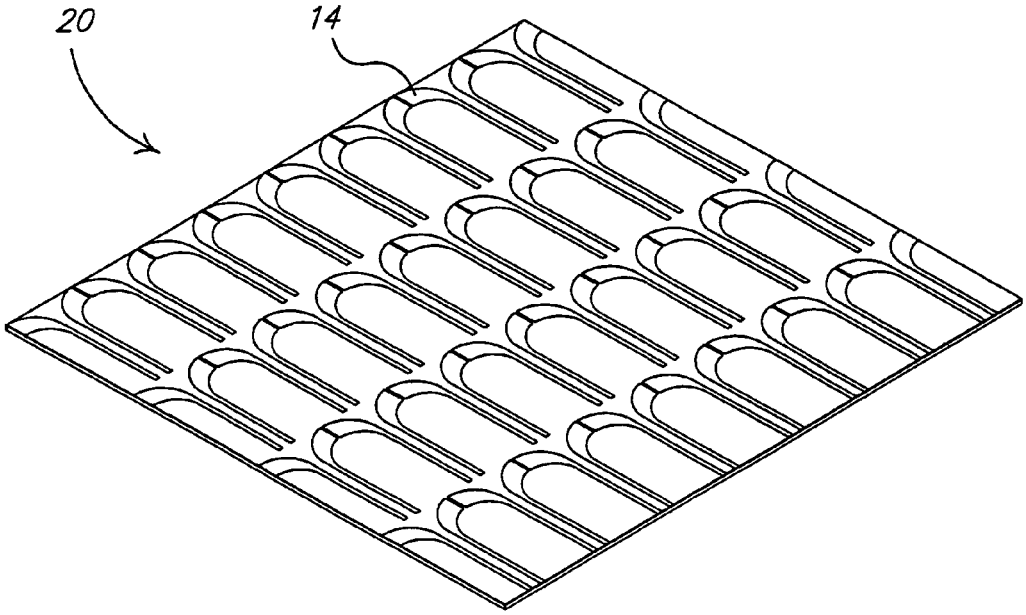
FIG. 2 is a perspective view of a material sheet having a plurality of electromagnetic radiating elements.

Referring now to FIG. 2, a substrate layer 20 is formed with a plurality of the radiating elements 14 on its surface with the elements 14 being formed, for example, in parallel rows on the substrate 20. In one preferred form the substrate 20 comprises a sheet of Kapton® polyimide film having a thickness of preferably about 0.0005–0.003 inch (0.0127 mm–0.0762 mm). The Kapton® film substrate 20 is coated with a copper foil that is then etched away to form the radiating elements 14 so that the elements 14 have a desired dimension and relative spacing.

Figure 3:
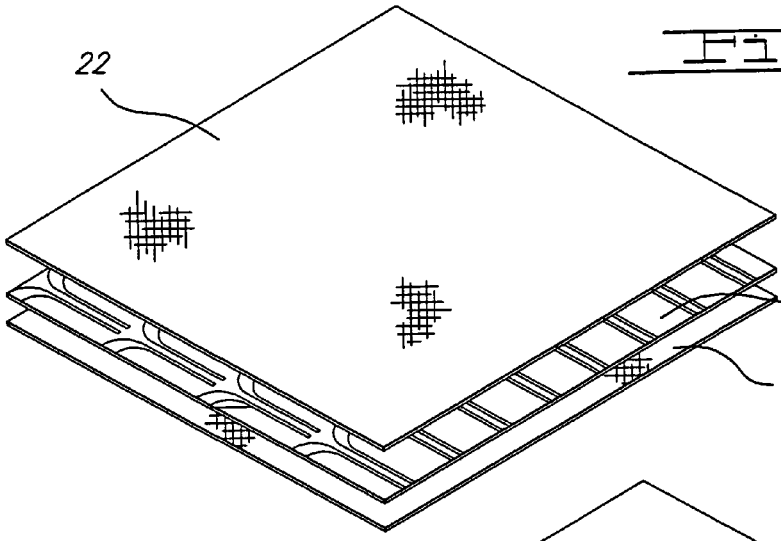
FIG. 3 is a perspective view of a pair of fabric prepreg plies positioned on opposite sides of the material sheet of FIG. 2, ready to be bonded together to sandwich the material sheet.

In FIG. 3, the substrate 20 is placed between two layers of resin rich prepreg fabric 22 and 24 and then cured flat in an oven or autoclave, typically for a period of 2–6 hours. The prepreg fabric 22 preferably comprises Astroquartz® fibers preimpregnated with Cyanate Ester resin to provide the desired electrical properties, especially dielectric and loss tangent properties. Other composite materials may also be used, such as fiberglass with epoxy resin.

Figure 4:
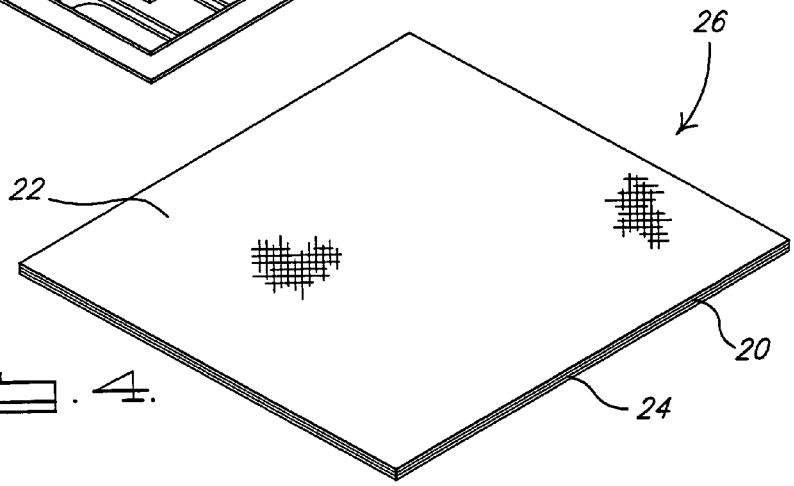
FIG. 4 is a perspective view of the subassembly of FIG. 3 after bonding.
Figure 5:
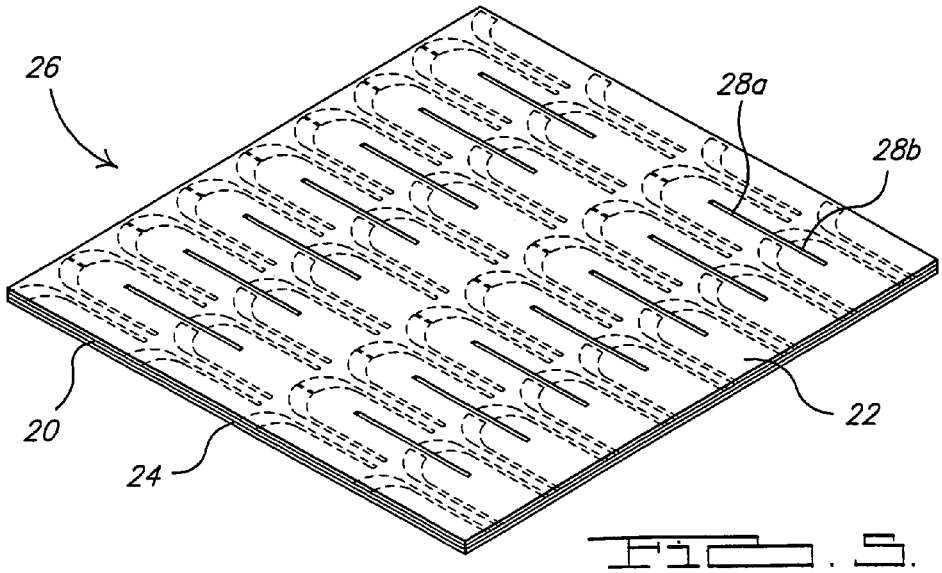
FIG. 5 is a perspective view of the assembly of FIG. 4 showing the slots that are cut to enable subsequent, interlocking assembly of wall portions of the antenna aperture.

As shown in FIG. 4, the component 26 forms a lightweight yet structurally rigid sheet with the radiating elements 14 sandwiched between the two prepreg fabric layers 22 and 24. Referring to FIG. 5, assembly slots 28 having portions 28*a* and 28*b* are then cut into the component 26 at spaced apart locations. Slots 28 facilitate intersecting assembly of the wall portions 12 (FIG. 1). Slots 28 are preferably water jet cut or machine routed into the component 26 to penetrate through the entire thickness of the component 26. Making the component 26 in large flat sheets allows a manufacturer to take advantage of precision, high rate manufacturing techniques involving copper deposition, silk screening, etc. Further, by including features in the flat component 26 such as the slots 28 and the radiating elements 14, one can insure very precise placement and repeatability of the radiating elements, which in turn allows coupling to external electronics with a high degree of precision.

Figure 6:
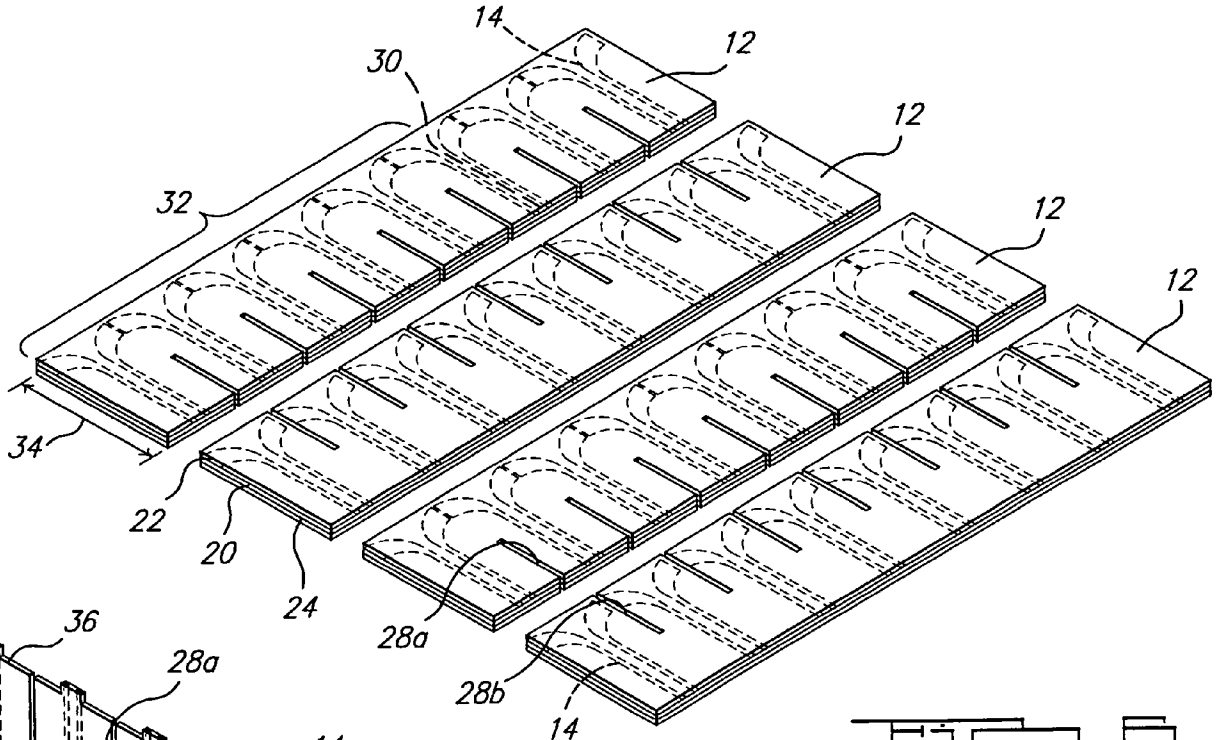
FIG. 6 is a view of the assembly of FIG. 5 with the assembly cut into a plurality of sections to be used as wall sections for the antenna aperture.

Referring to FIG. 6, the component 26 is then cut into a plurality of sections that form wall portions 12. If the antenna aperture 10 will be rectangular in shape, rather than square, then an additional cut will be made to shorten the length of those wall portions 12 that will form the short side portions of the aperture 10. For example, a cut may be made along dash line 30 so that the resultant length 32 may be used to form one of the two shorter sides of the aperture 10 of FIG. 1. Distance 34 represents the overall height that the antenna aperture 10 will have. The wall sections 12 may also be planed to a specific desired thickness. In one preferred implementation, a thickness of between about 0.015 inch–0.04 inch (0.381 mm–1.016 mm) for the wall sections 12 is preferred.

Figure 7:
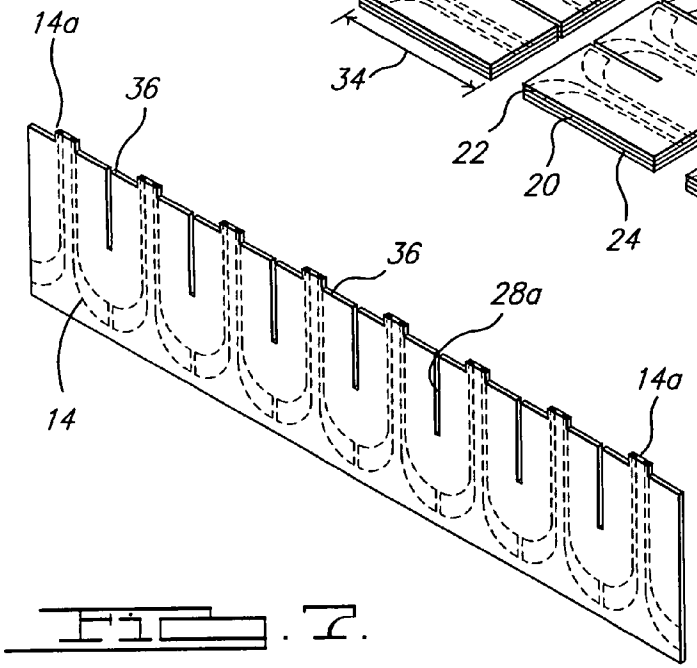
FIG. 7 illustrates the notches that are cut along one edge of each wall section to form teeth at a terminal end of each radiating element.

Referring to FIG. 7, an edge of each wall section may be cut to form notches 36 between terminal ends of each radiating element 14. The notches 36 enable the terminal ends of each radiating element 14 to form the teeth 14*a* (also illustrated in FIG. 1). However, the formation of teeth 14*a* is optional.

Assembly of Wall Sections

Figure 8:
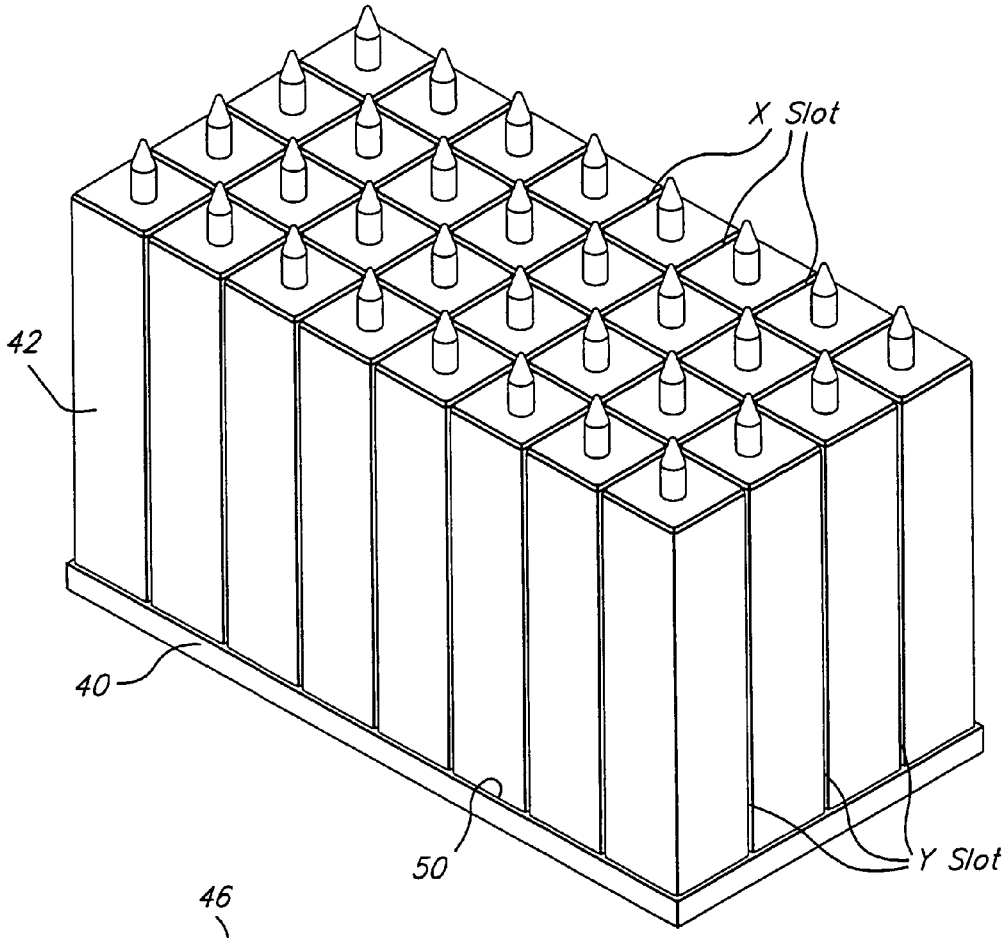
FIG. 8 is a view of a tool used to align the wall sections of the aperture during an assembly process.

Referring to FIG. 8, a tool 38 that is used to support the wall sections 12 during forming of the aperture 10 is shown. The tool 38 comprises a base 40 that is used to support a plurality of metallic blocks 42 in a highly precise orientation to form a plurality of perpendicularly extending slots. For convenience, one group of slots has been designated as the "X-direction" slots and one group as the "Y-direction" slots.

Figure 9:
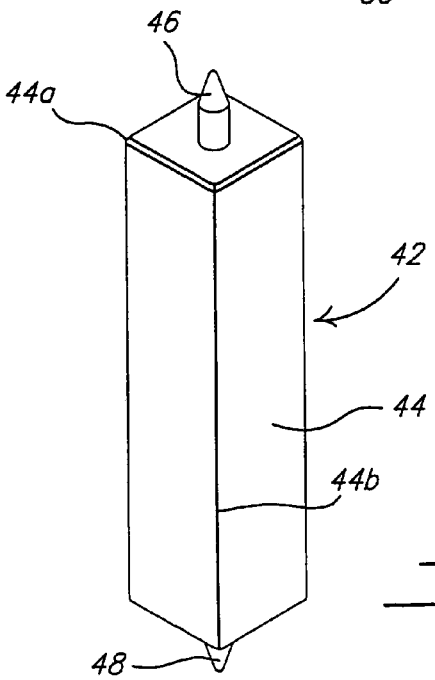
FIG. 9 is a perspective view of one metallic block shown in FIG. 8.

Referring to FIG. 9, one of metallic blocks 42 is shown in greater detail. Metallic block 42 includes a main body 44 that is generally square in cross sectional shape. Upper and lower locating pins 46 and 48, respectively, are located at an axial center of the main body 44. Each metallic block 42 is preferably formed from aluminum but may be formed from other metallic materials as well. The main body 44 of each metallic block 42 further preferably has radiused upper corners 44*a* and radiused longitudinal corners 44*b*. The metallic blocks 42 also preferably include a polished outer surface.

Figure 10:
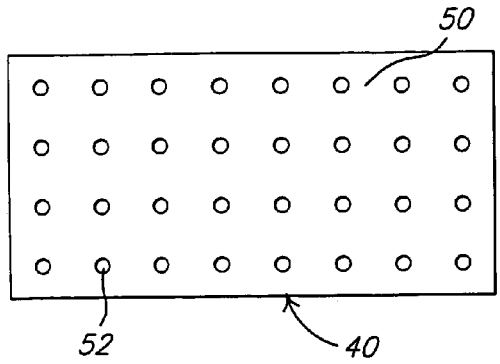
FIG. 10 is a plan view of the lower surface of a top plate that is removably secured to each of the mounting blocks of FIG. 8 during the assembly process.

With brief reference to FIG. 10, an upper surface 50 of the base plate 40 is shown. The upper surface 50 includes a plurality of precisely located recesses 52 for receiving each of the lower locating pins 48 of each metallic block 42. The recesses 52 serve to hold the metallic blocks 42 in a highly precise, spaced apart alignment that forms the X-direction slots and the Y-direction slots.

Figure 11:
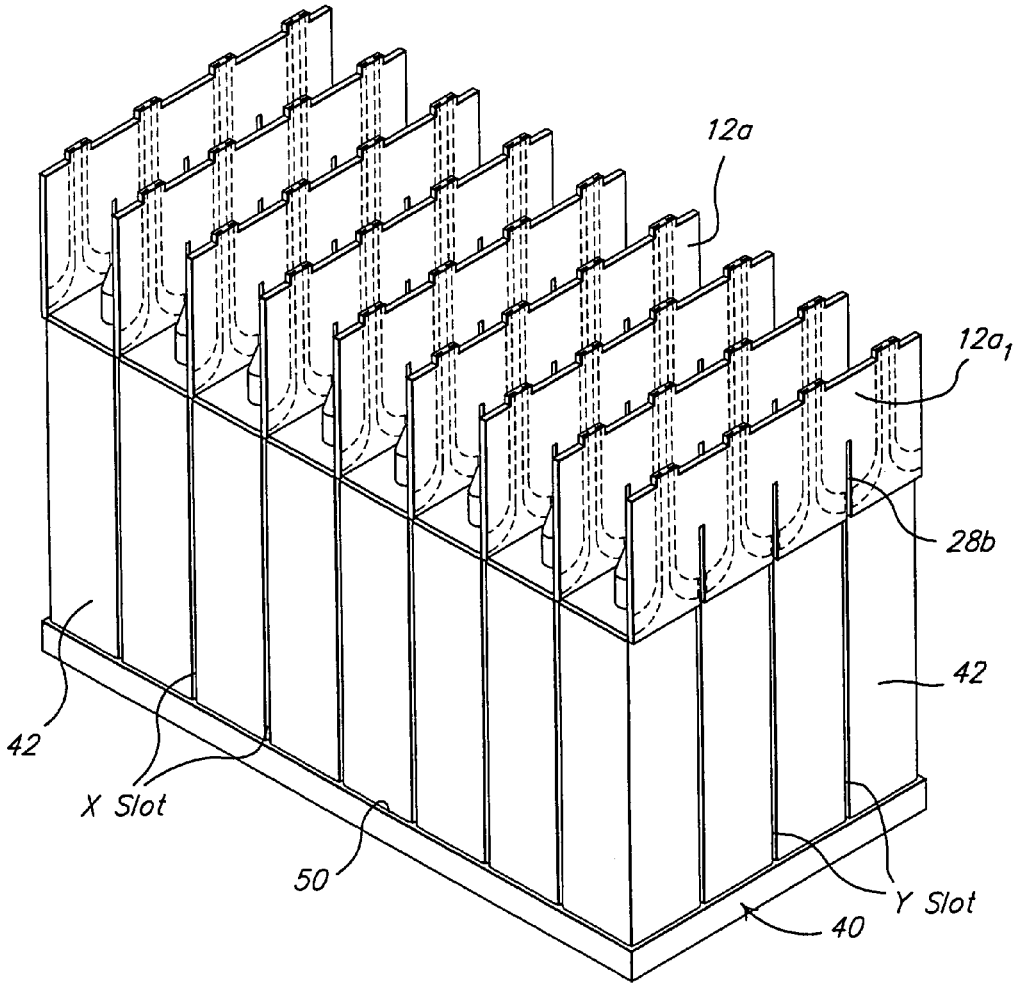
FIG. 11 is a perspective view illustrating a plurality of wall sections being inserted in X-direction slots formed by the tool.
Figure 12:
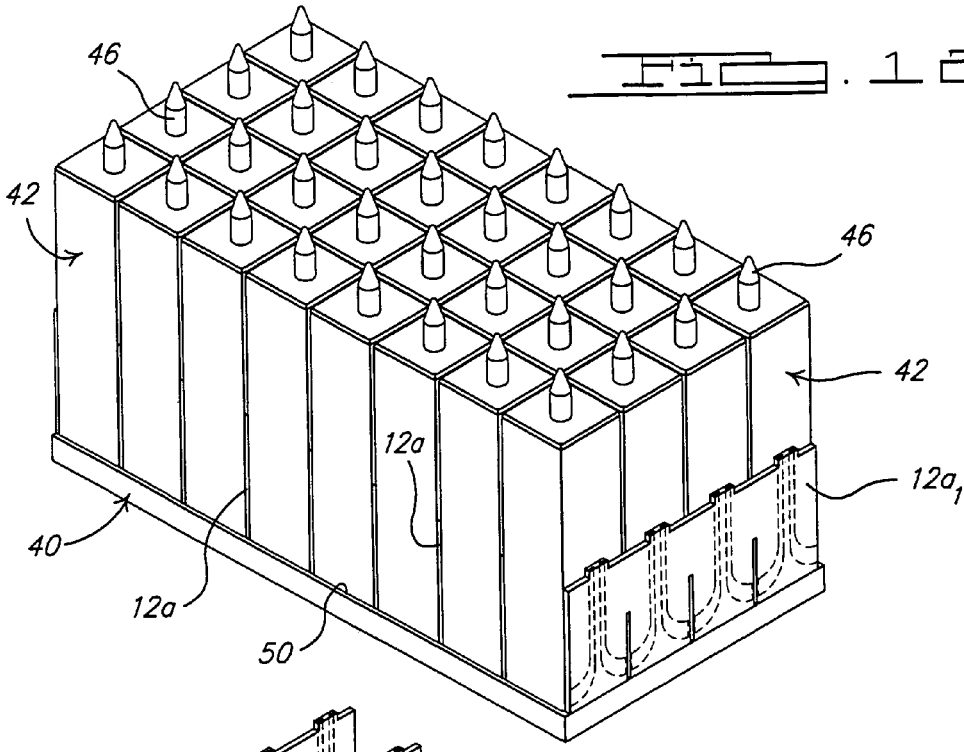
FIG. 12 shows the wall sections of FIG. 11 fully inserted into the tool, along with a pair of outer perimeter wall sections being temporarily secured to perimeter portions of the tool.

Referring to FIG. 11, a first subplurality of the wall sections 12 that will form the X-direction walls of the aperture 10 are inserted into the X-direction slots. For convenience, these wall sections will be noted with reference numeral 12*a*. Each of the wall sections 12*a* include slots 28*b* and are inserted such that slots 28*b* will be adjacent the upper surface 50 of the base plate 40 once fully inserted into the X-direction slots. Outermost wall sections $12a_1$ may be temporarily held to longitudinal sides of the metallic blocks 42 by Mylar® PET film or Teflon® PTFE tape. FIG. 12 shows each of the wall sections 12*a* seated within the X-direction slots and resting on the upper surface 50 of the base plate 40.

Figure 13:
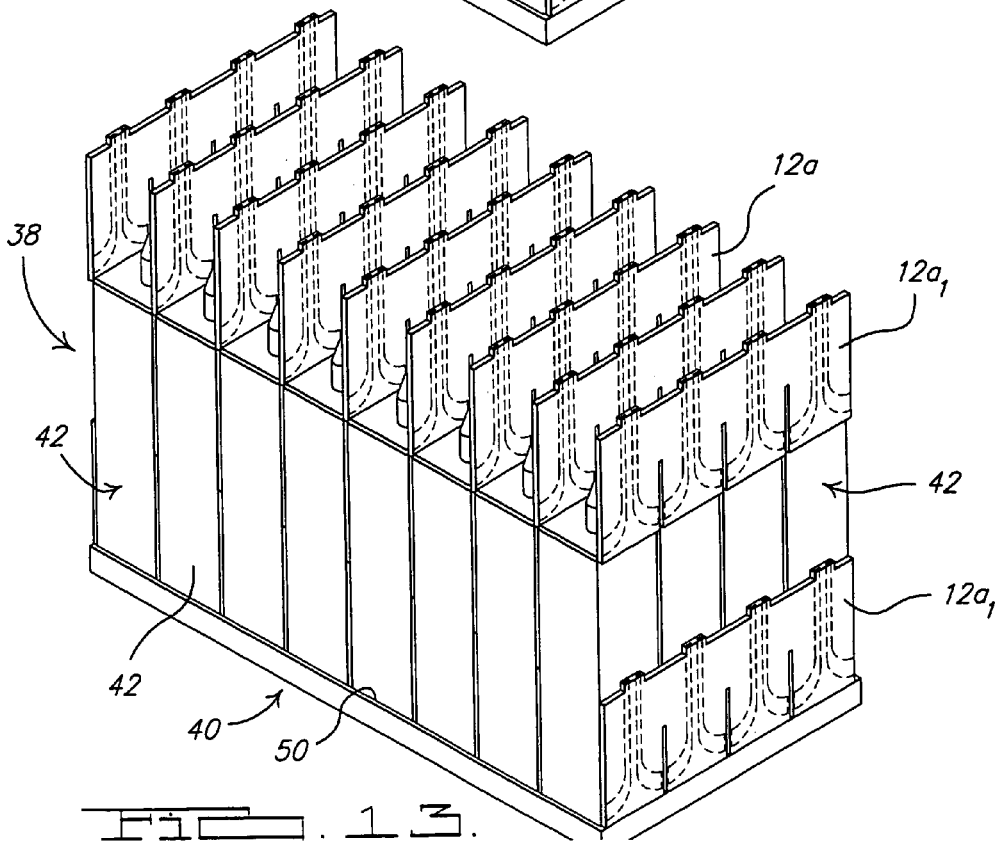
FIG. 13 illustrates a second plurality of wall sections being inserted into the X-direction rows of the tool.
Figure 14:
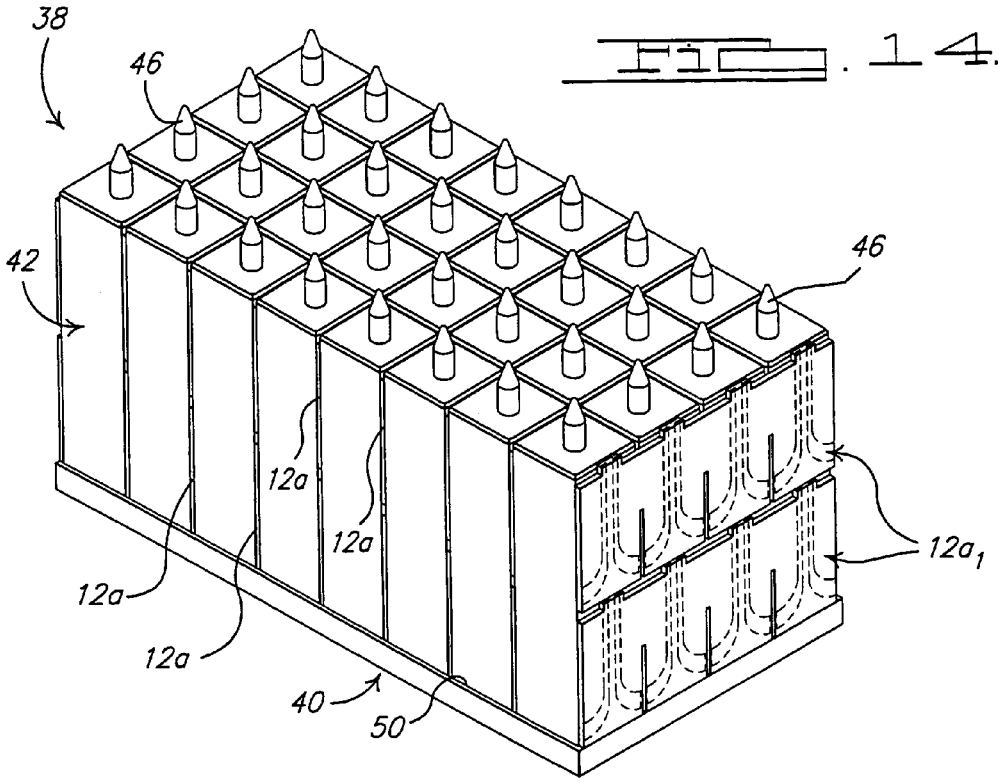
FIG. 14 illustrates the second plurality of wall sections fully inserted into the tool.

Referring to FIG. 13, a second vertical layer of wall sections 12*a* may then be inserted into the X-direction slots. A second subplurality of wall sections $12a_1$ are similarly secured along the short sides of the tool 38. The second plurality of wall sections 12*a* rest on the first plurality. FIG. 14 shows the second subplurality of wall sections 12*a* fully inserted into the X-direction slots.

Figure 15:
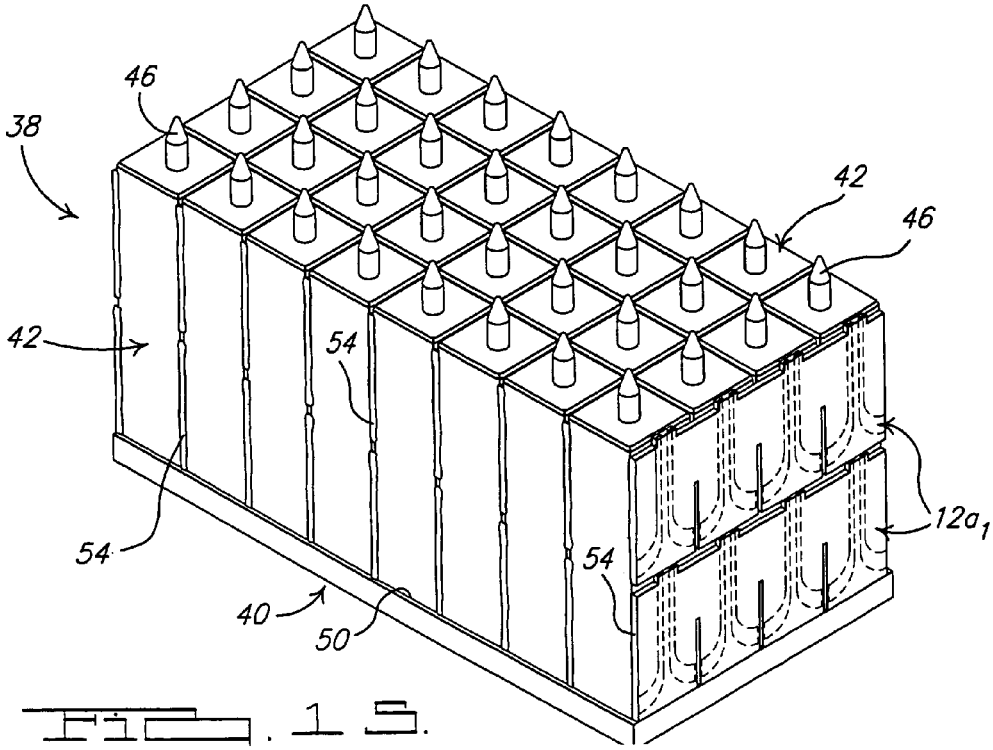
FIG. 15 illustrates areas where adhesive is applied to edge portions of the wall sections.
Figure 16:
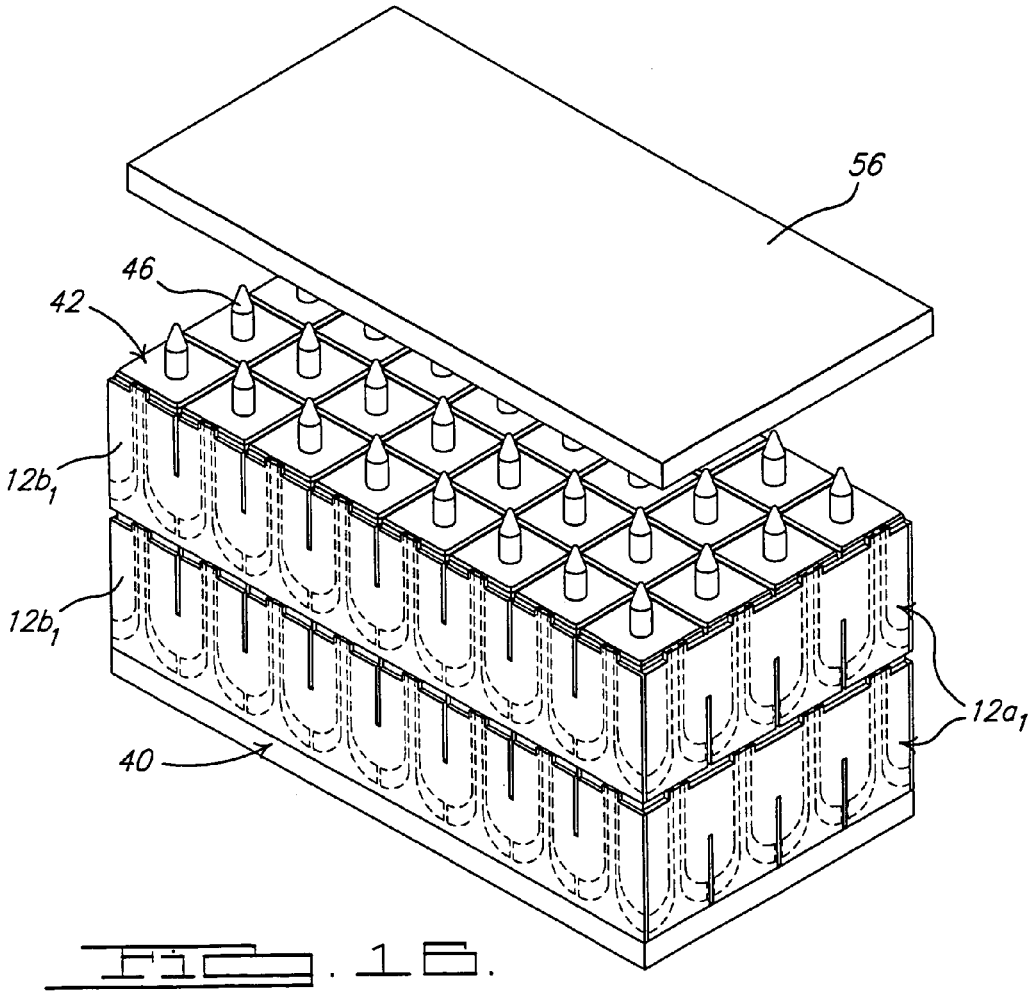
FIG. 16 illustrates additional wall sections secured to the long, perimeter sides of the tool, together with a top plate ready to be secured over the locating pins of the metallic blocks.
Figure 17:
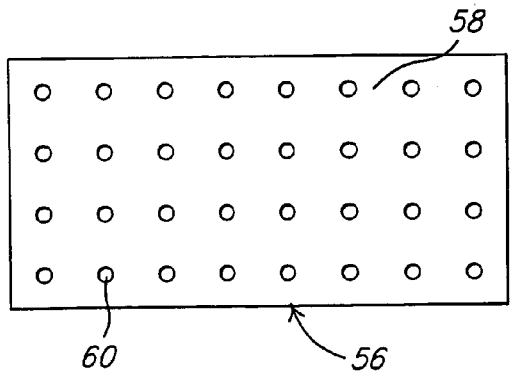
FIG. 17 is a view of the lower surface of the top plate showing the recesses therein for receiving the locating pins of each metallic block.

Referring to FIG. 15, beads of adhesive 54 are placed along edges of each of wall sections 12*a* and $12a_1$. In FIG. 16, Y-direction rows $12b_1$ are then placed along the longer longitudinal sides of the tool 38 and are adhered to the edges of rows 12*a* and 12*a*$_1$ by the adhesive 54. The entire assembly of FIG. 16 is then covered with a top plate 56. Top plate 56 is also shown in FIG. 17 and has a lower surface 58 having a plurality of recesses 60 for accepting the upper locating pins 46 of each metallic block 42. Top plate 56, in combination with base plate 40, thus holds each of the metallic blocks 42 in precise alignment to maintain the X-direction slots and Y-direction slots in a highly precise, perpendicular configuration.

Initial Bonding of Wall Sections

Figure 21:
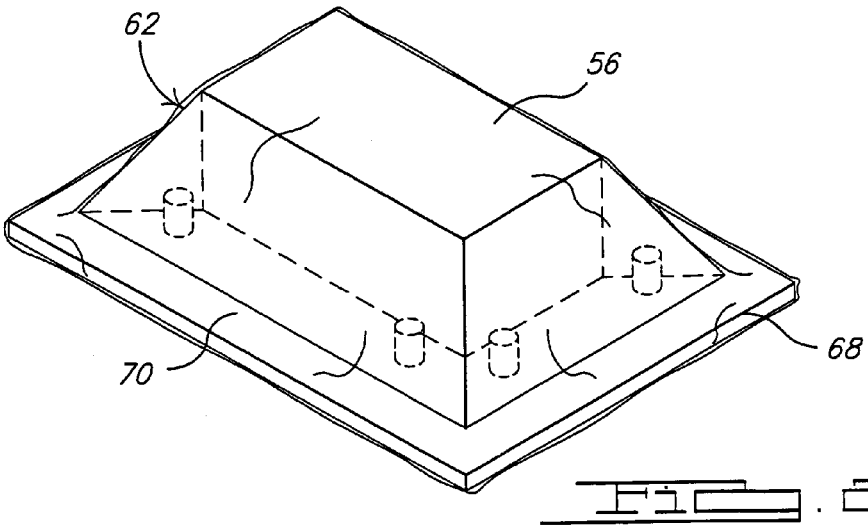
FIG. 21 is a view of the tool of FIG. 18 in a compaction bag, while a compaction operation is being performed.

Referring to FIGS. 18 and 19, the entire assembly of FIG. 16 is placed within four components 62*a*–62*d* of a tool 62. Each of sections 62*a*–62*d* includes a pair of bores 64 that receive a metallic pin 66 therethrough. One of the tool sections 62*d* is shown in FIG. 20 and can be seen to be slightly triangular when viewed from an end thereof. In FIGS. 18 and 19 the pins 66 are received within openings in a table 68 to hold the subassembly of FIG. 16 securely during a cure phase. Tool 62, as well as top plate 56 and base plate 40, are all preferably formed from Invar. In FIG. 21 the tool 62 is covered with a vacuum bag 70 and the subassembly within the tool 62 is bonded. Bonding typically takes from 4–6 hours. The metallic blocks expand during the compacting phase to help provide the compacting force applied to the wall sections 12.

Figure 22:
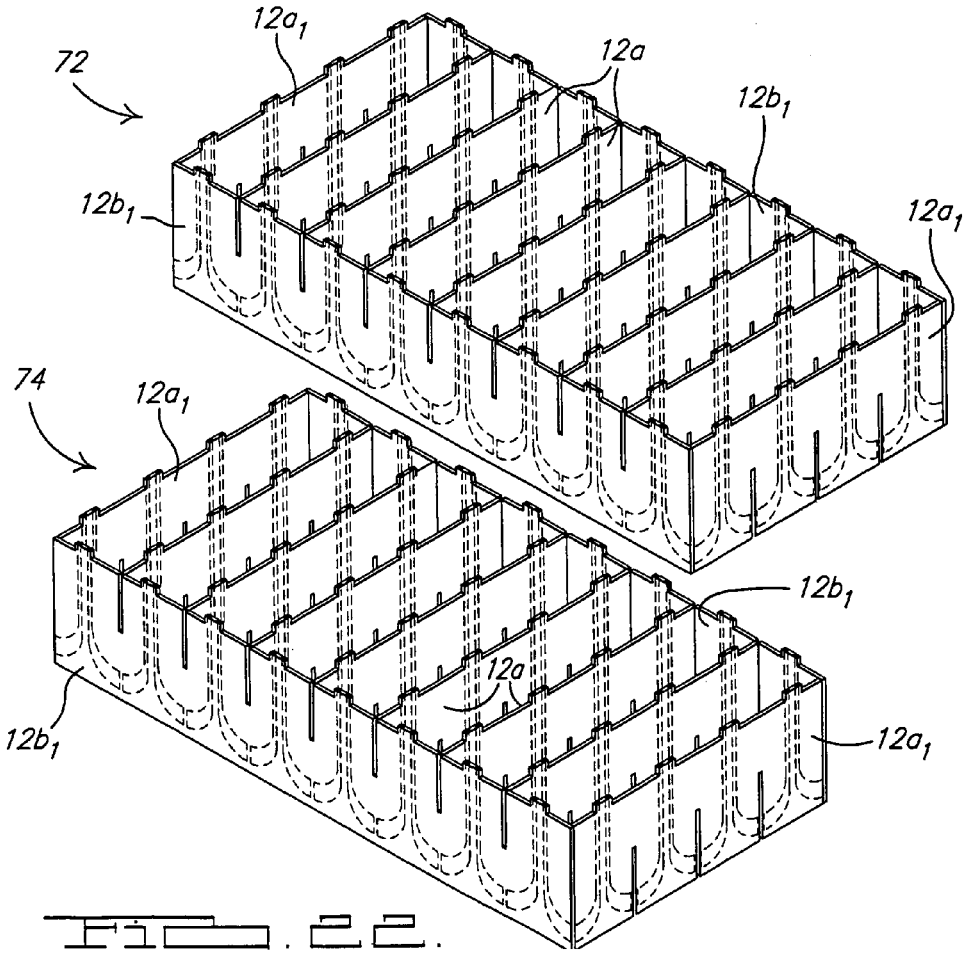
FIG. 22 illustrates the two independent subassemblies formed during a compaction step of FIG. 21 after removal from the compacting tool.

Referring to FIG. 22, after the compacting step shown in FIG. 21 is performed, the tool 62 is removed, the top plate 56 is removed and a pair of independent subassemblies 72 and 74 each made up of wall sections 12*a*, 12*a*$_1$ and 12*b*$_1$ are provided. Each of subassemblies 72 and 74 form structurally rigid, lightweight subassemblies.

Formation of Grid and Securing of Back Skin

Figure 23:
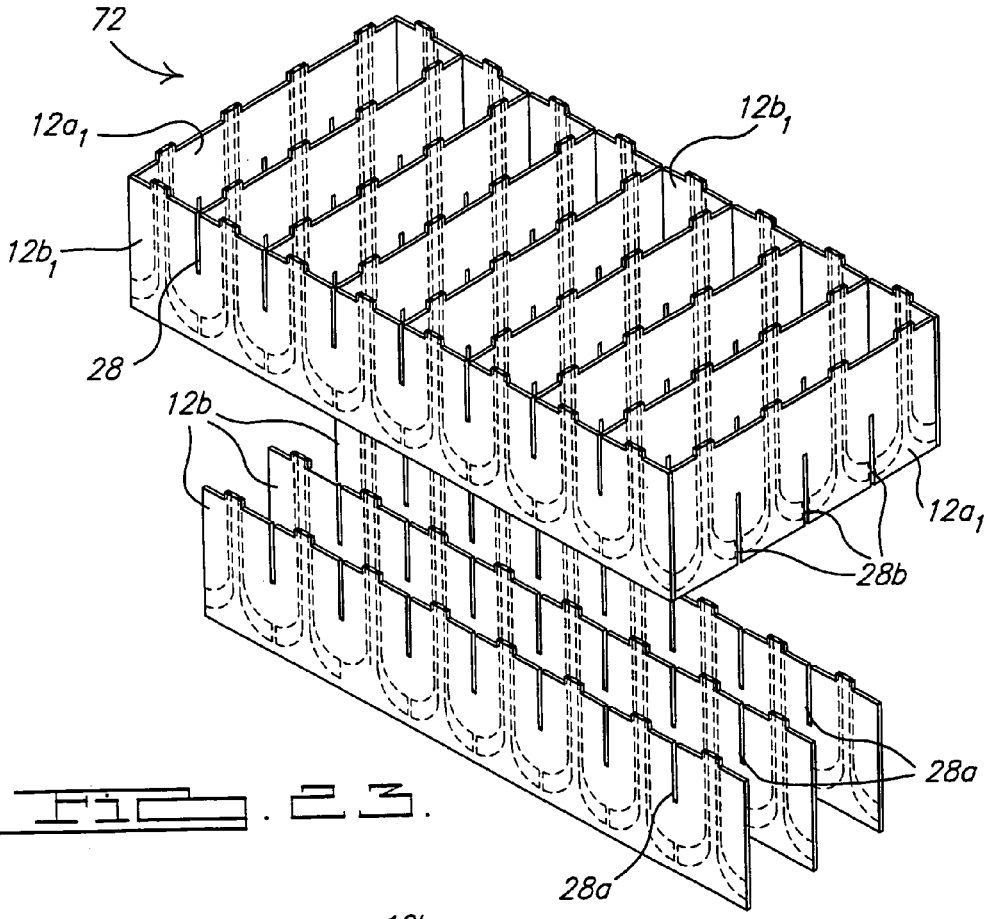
FIG. 23 illustrates Y-direction wall portions being inserted into one of the previously formed subassemblies shown in FIG. 22.
Figure 24:
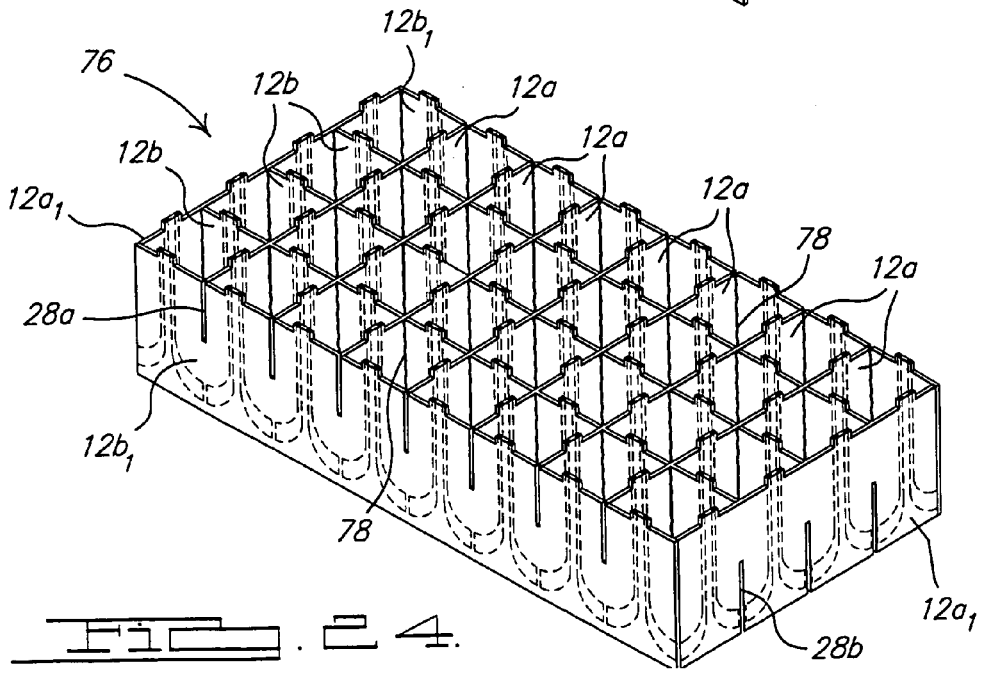
FIG. 24 shows the areas in which adhesive is placed for bonding intersecting areas of the wall sections.

Referring to FIG. 23, the completion of subassembly 72 will be described. The completion of assembly of subassembly 74 is identical to what will be described for subassembly 72. In FIG. 23, a plurality of wall sections 12*b* are inserted into the Y-direction slots of the subassembly 72 to form columns. The wall sections 12*b* are inserted such that slots 28*a* intersect with slots 28*b*. The resulting subassembly, designated by reference numeral 76, is shown in FIG. 24. Adhesive 78 is then placed at each of the interior joints of the subassembly 76 where wall portions 12*a* and 12*b* meet. The adhesive may be applied with a heated syringe or any other suitable means that allows the corners where the wall sections 12 intersect to be lined with an adhesive bead.

Figure 25:
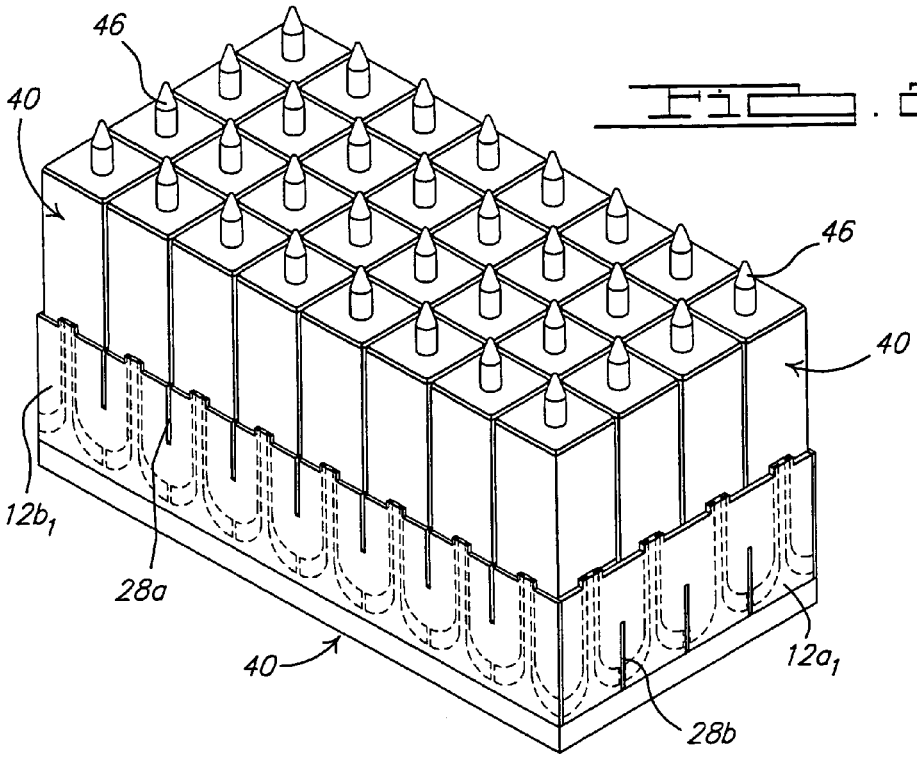
FIG. 25 shows the subassembly of FIG. 24 after it has been lowered onto the alignment tool.
Figure 26:
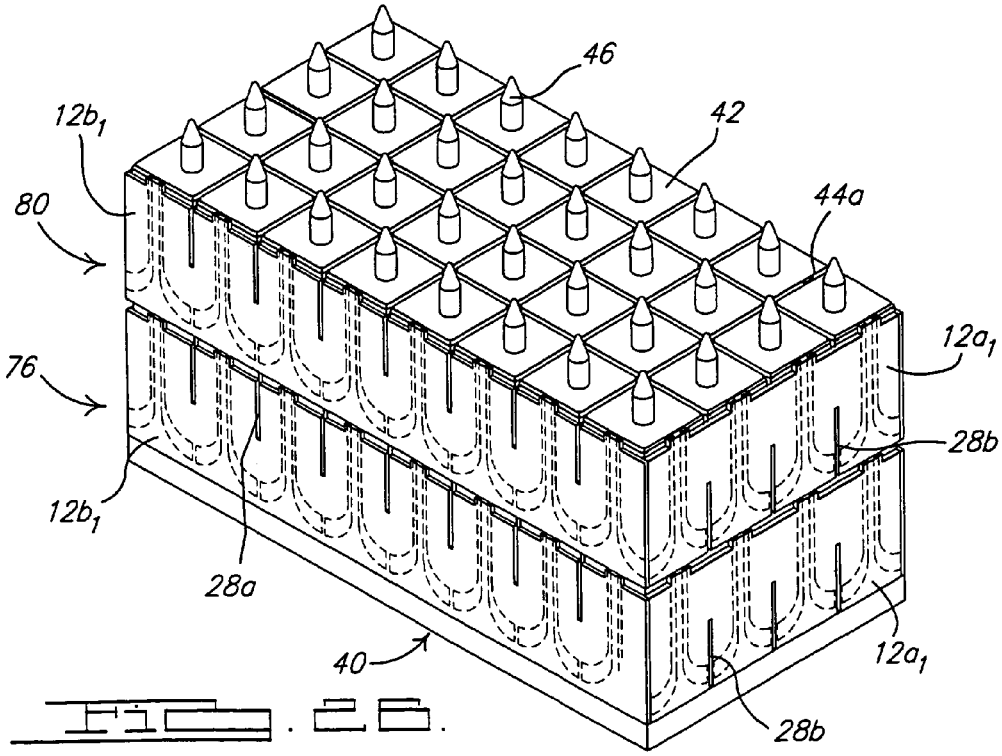
FIG. 26 shows both of the aperture subassemblies positioned on the alignment tool and ready for compacting and curing.

Referring to FIG. 25, the resulting subassembly 76 is placed over the tool 38 and then an identical subassembly 80, formed from subassembly 74, is placed on top of subassembly 76. Any excess adhesive that rubs off onto the tapered edges 44*a* of each of the metallic blocks 42 is manually wiped off.

Figure 27:
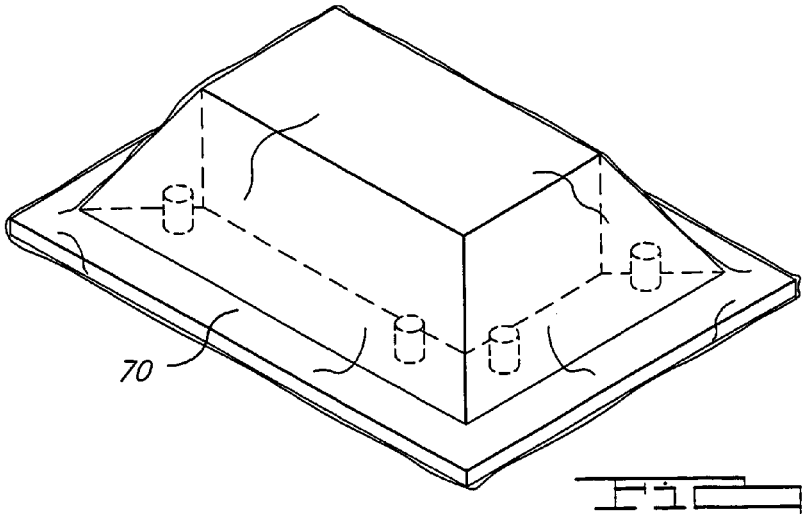
FIG. 27 illustrates the subassembly of FIG. 26 again placed within the compaction tool initially shown in FIG. 18.

Referring to FIG. 27, a second bond/compaction cycle is performed in a manner identical to that described in connection with FIGS. 18–21. Again, the expansion of the metallic blocks 40 helps to provide the compaction force on the wall sections 12.

Figure 28:
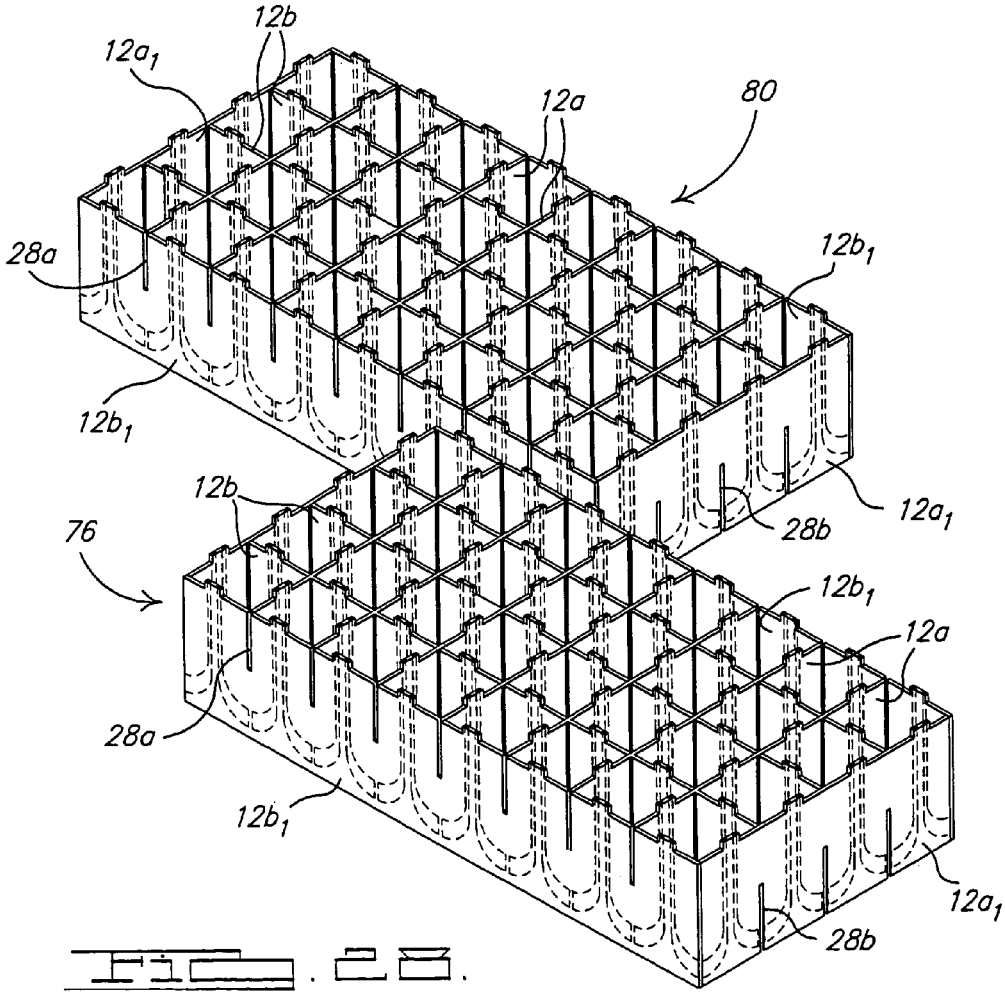
FIG. 28 shows the two independent aperture subassemblies formed after removal from the tool in FIG. 27.

Referring to FIG. 28, after the bond/compaction operation of FIG. 27 is completed, the two subassemblies 80 and 76 are removed from the tool 62 and then from the tool 38. Each of subassemblies 80 and 76 form rigid, lightweight, structurally strong assemblies having a plurality of cells 76*a* and 80*a*. The size of the cells 80*a*, 76*a* may vary depending on desired antenna performance factors and the load bearing requirements that the antenna aperture 10 must meet. The specific dimensions of the antenna elements 14 will generally be in accordance with the length and height of the individual cells 80*a*, 76*a*. In one preferred form suitable for antenna or sensor applications in the GHz range, the cells 76*a* and 80*a* are about 0.5 inch in length×0.5 inch in width×0.5 inch in height (12.7 mm×12.7 mm×12.7 mm). The overall length and width of each subassembly 76 and 80 will vary depending on the number of radiating elements 14 that are employed, but can be on the order of about 1.0 ft×1.0 ft (30.48 cm×30.48 cm), and subsequently secured adjacent to one another to form a single array of greater, desired dimensions. The fully assembled antenna system 10 may vary from several square feet in area to possibly hundreds of square feet in area or greater. While the cells 80*a*, 76*a* are illustrated as having a square shape, other shaped cells could be formed, such as triangular, round, hexagonal, etc.

Figure 29:
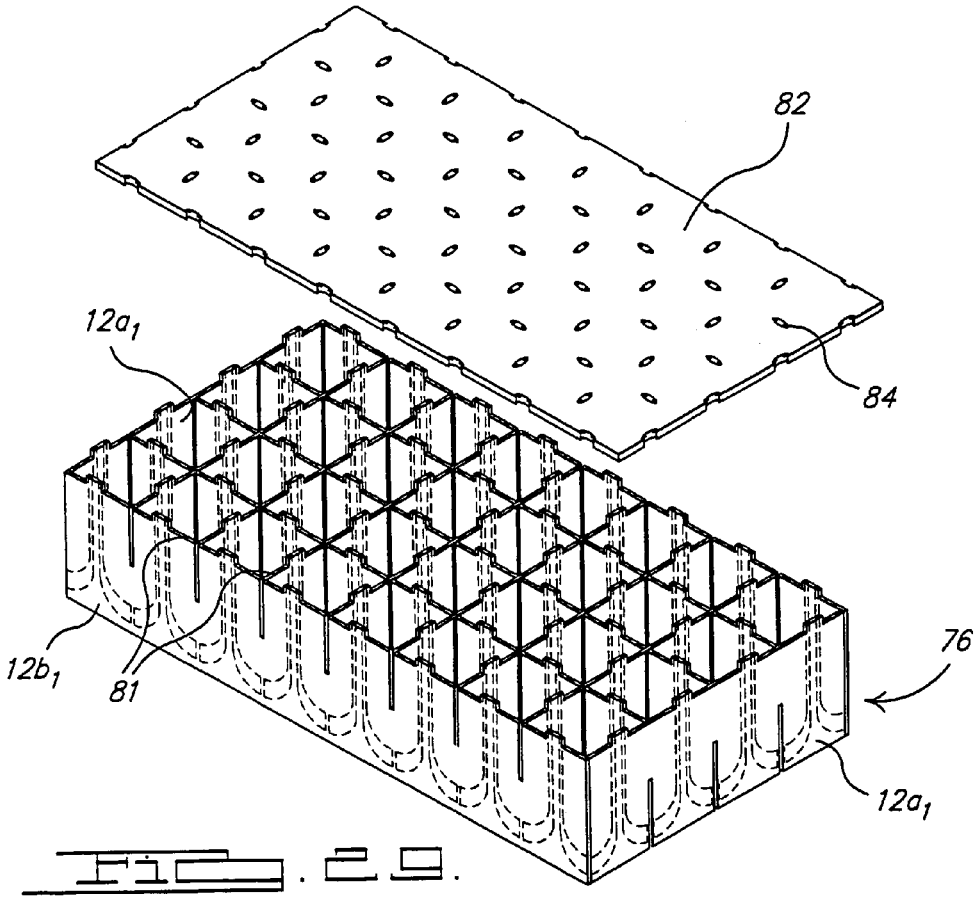
FIG. 29 illustrates a back skin being secured to one of the antenna aperture assemblies of FIG. 28.

Referring to FIG. 29, beads of adhesive 81 are placed along each exposed edge of each of the wall sections 12. A back skin 82 having a plurality of precisely machined openings 84 is then placed over each subassembly 80 and 76 such that the teeth 14*a* of each radiating element 14 project through the openings 84. The back skin 82 is preferably a prepreg composite material sheet that has been previously cured to form a structurally rigid component. In one preferred form the back skin 82 is comprised of a plurality of layers of Astroquartz® prepreg fibers preimpregnated with Cyanate Ester resin. The thickness of the backskin 82 may vary as needed to suit specific load bearing requirements. The higher the load bearing capability required, the thicker the backskin 82 will need to be. In one preferred form the backskin 82 has a thickness of about 0.050 inch (1.27 mm), which together with wall sections 12 provides the aperture 10 with a density of about 8 lbs/cubic foot (361 kg/cubic meter). The backskin 82 could also be formed with a slight curvature or contour to match an outer mold line of a surface into which the antenna aperture 10 is being integrated.

Figure 30:
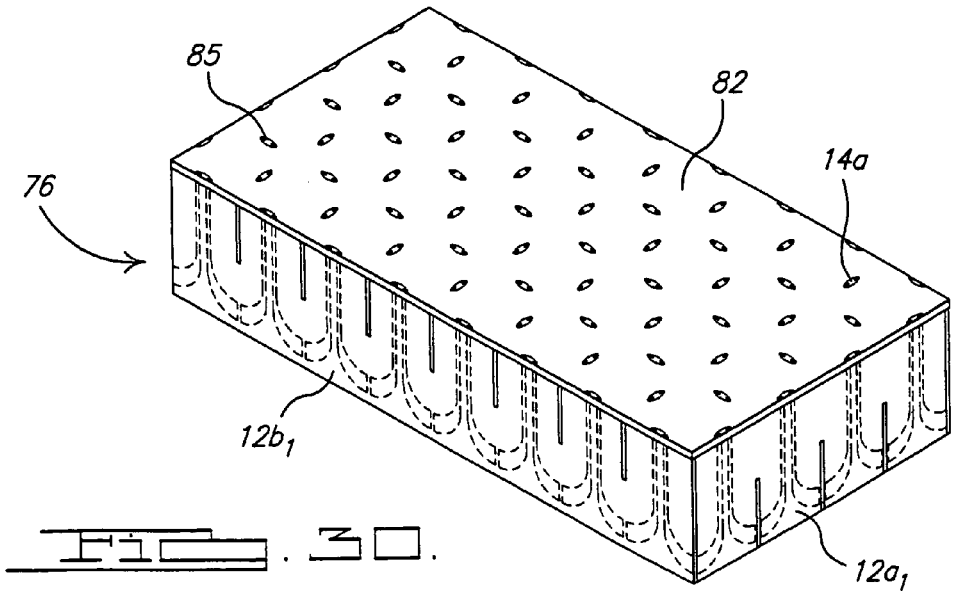
FIG. 30 illustrates the filled holes in the back skin, thus leaving only teeth on the radiating elements exposed.

In FIG. 30, after the back skin 82 is placed on the assembly 76, the openings 84 are filled with an epoxy 85 such that only the teeth 14*a* of each radiating element 14 are exposed. The back skin is then compacted onto the remainder of the subassembly and cured in an autoclave for preferably 2–4 hours at a temperature of about 250° F.–350° F., at a pressure of about 80–90 psi. The adhesive beads 81 and 54 form fillets that help to provide the aperture 10 with excellent structural strength.

Alternative Assembly Method of Wall Sections

Figure 31:
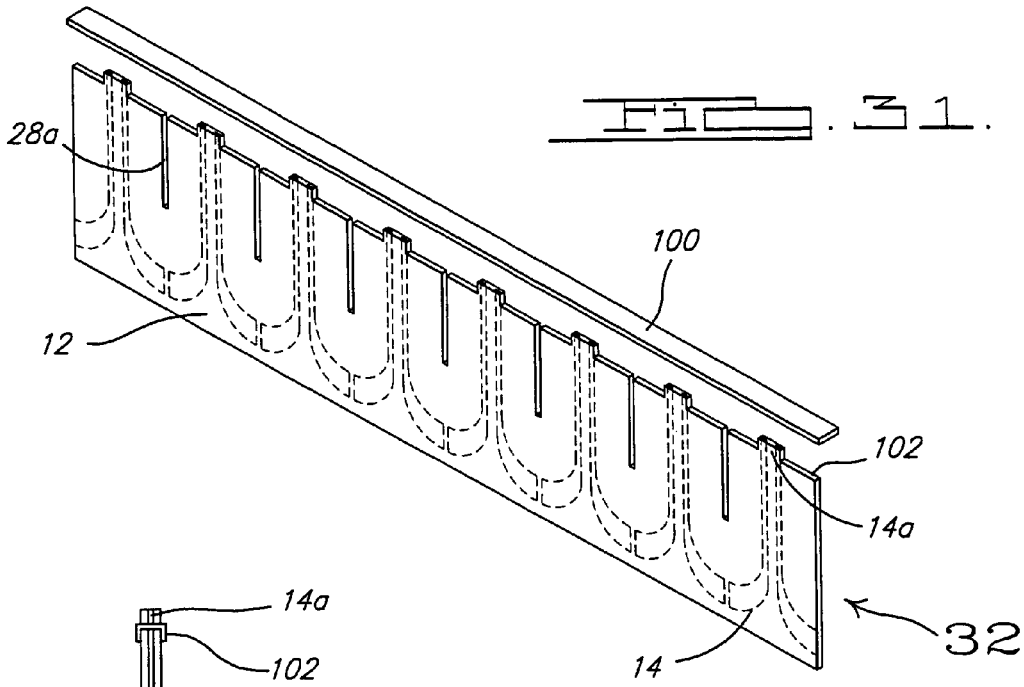
FIG. 31 is a perspective view of the wall section and an adhesive strip for use in connection with an alternative preferred method of construction of the antenna aperture.
Figure 32:
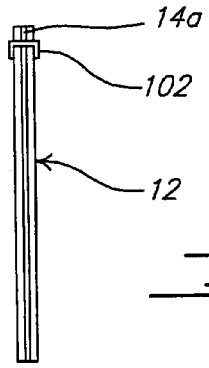
FIG. 32 is an end view of the wall section of FIG. 31 with the adhesive strip of FIG. 31.
Figure 33:
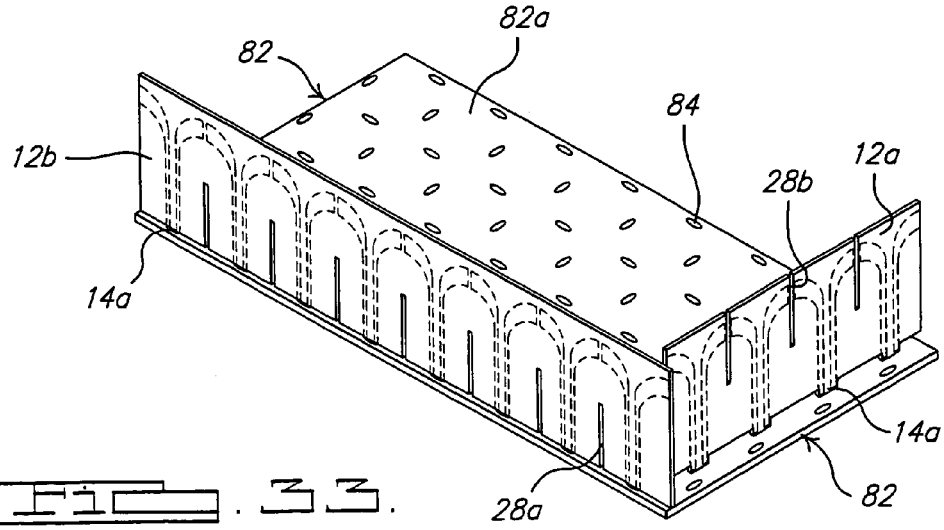
FIG. 33 is a perspective view of the wall sections being secured to a backskin.

Referring to FIGS. 31–37, an alternative preferred method of constructing the antenna aperture 10 is shown. With this method, the wall sections 12 are assembled as a complete X-Y grid onto a backskin, then the entire assembly is cured in one step. Referring specifically to FIG. 31, each wall section 12 has an adhesive strip 100 pressed over an edge 102 adjacent the teeth 14*a* of the radiating elements 14. Adhesive strip 100 is preferably about 0.015 inch thick (0.38 mm) and has a width of preferably about 0.10 inch (2.54 mm). The strip 14 can be a standard, commercially available epoxy or Cyanate Ester film. The strip 100 is pressed over the teeth such that the teeth 14*a* pierce the strip 100. The strip 100 is tacky and temporarily adheres to the upper edge 102. Referring to FIG. 32, portions of the adhesive strip 102 are folded over opposing sides of the wall section 12. This is performed for each one of the X-direction walls 12*a* and each one of the Y-direction walls 12*b*. Referring to FIG. 33, each of the wall sections 12*a* and 12*b* are then assembled onto the backskin 82 one by one. This involves carefully aligning and using sufficient manual force to press each of the teeth 14*a* on each wall section 12 through the openings 84 in the backskin 82. The adhesive strips 102 help to hold each of the wall sections 12 in an upright orientation. The interlocking connections of the wall sections 12*a* and 12*b* also serve to temporarily hold the wall sections 12 in place.

Figure 34:
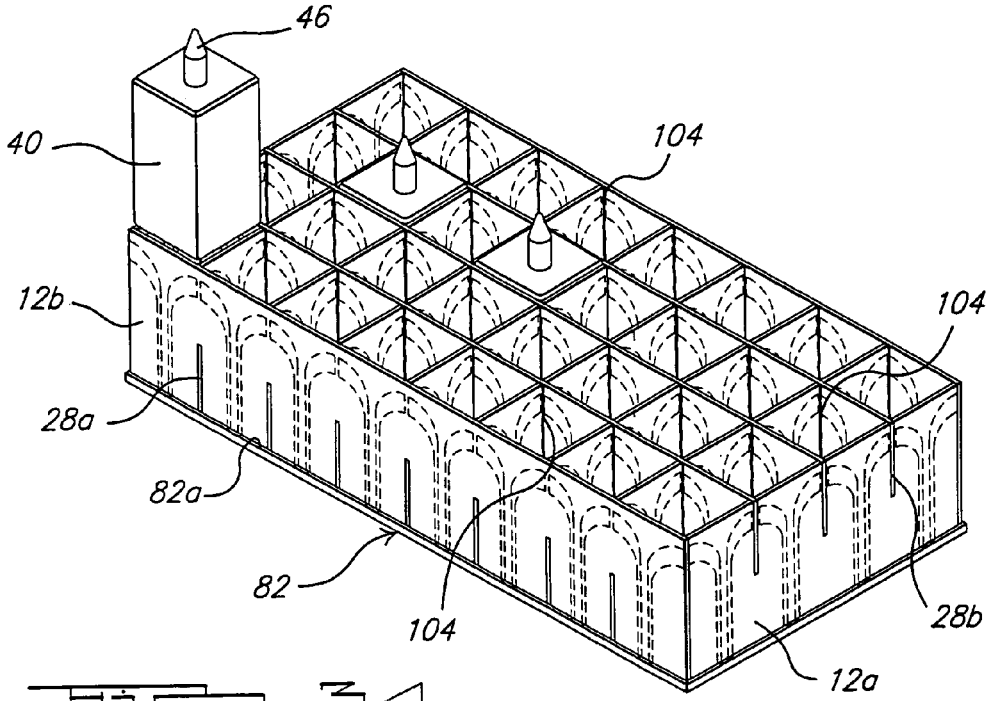
FIG. 34 is a view of the wall sections secured to the backskin with the metallic blocks being inserted into the cells formed by the wall sections.

Referring to FIG. 34, adhesive beads 104 are then applied at each of the areas where wall sections 12*a* and 12*b* intersect. The metallic blocks 40 are then inserted into each of the cells formed by the wall sections 12*a* and 12*b*. The insertion of each metallic block 40 helps to form the adhesive beads 104 into fillets at the intersections of each of the wall sections 12. Excess adhesive is then wiped off from the metallic blocks 40 and from around the intersecting areas of the wall sections 12.

Figure 35:
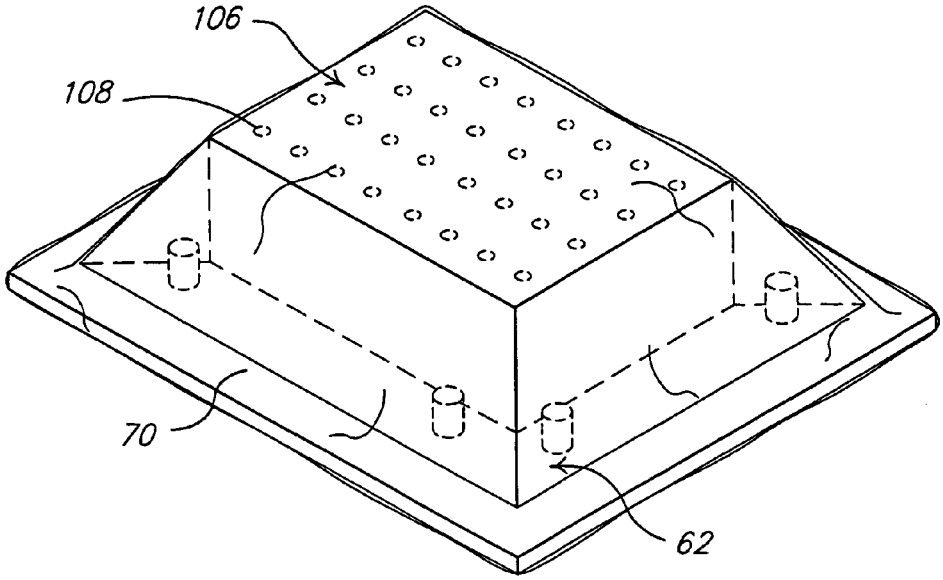
FIG. 35 is a view of the assembly of FIG. 34 being vacuum compacted.
Figure 36:
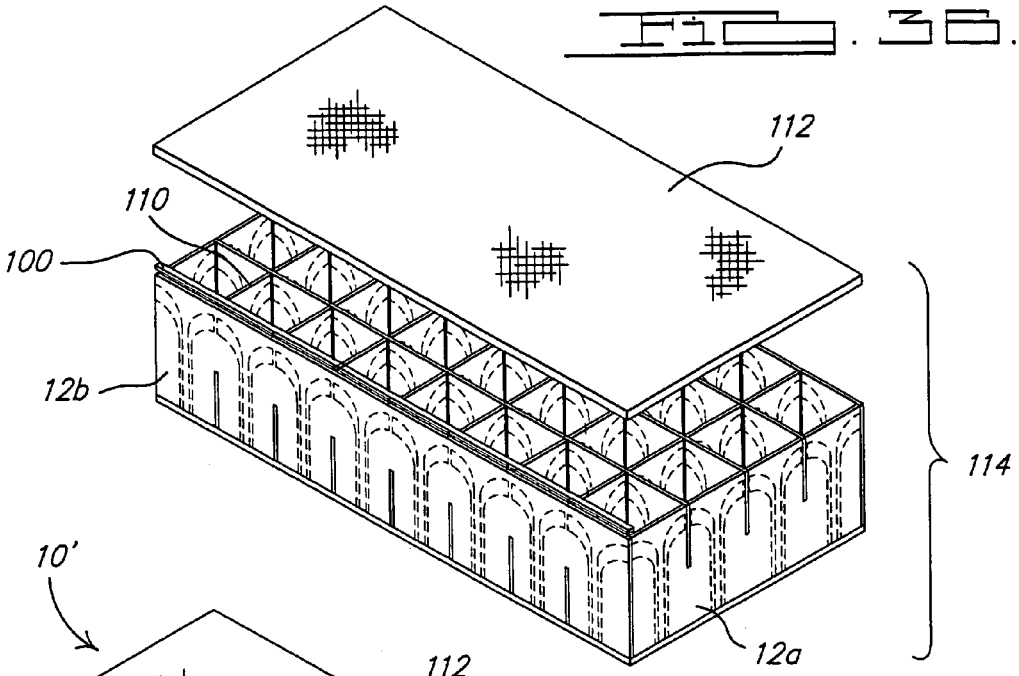
FIG. 36 is a view of a radome positioned over the just-compacted subassembly, with adhesive strips being positioned over exposed edge portions of the wall sections.
Figure 37:
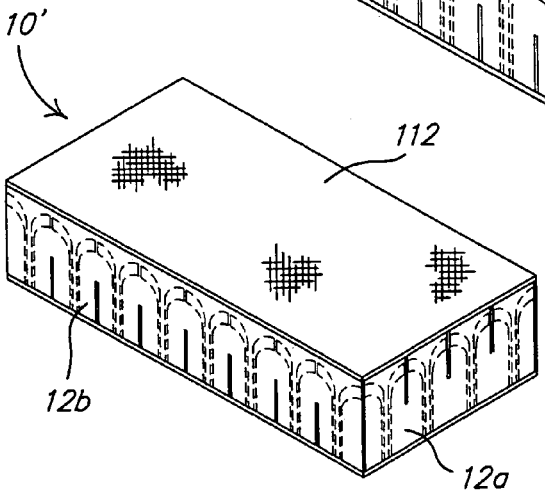
FIG. 37 is a view of the compacted and cured assembly of FIG. 36.
Figure 38:
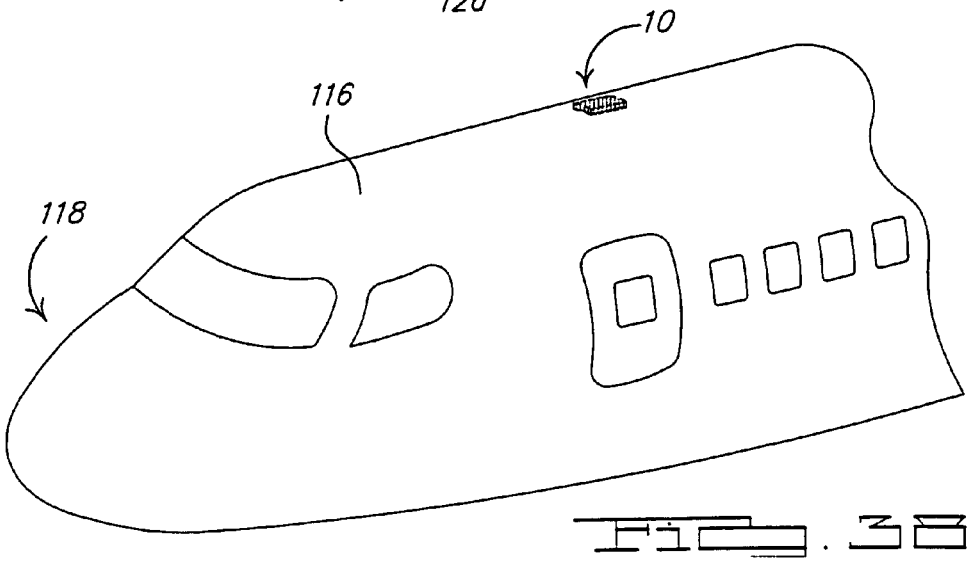
FIG. 38 illustrates the antenna aperture integrally formed with a fuselage of an aircraft.

Referring to FIG. 35, a metallic top plate 106 having a plurality of recesses 108 is then pressed onto the upper locating pins 46 of each of the metallic blocks 40. The assembly is placed within vacuum bag 70 and bonded using tool 62. Referring to FIG. 36, the assembly is removed from the tool 62, top plate 106 is removed, and the metallic blocks 40 are removed. Adhesive strips 100 and 110 are then pressed over exposed edge portions of each of the wall sections 12*a* and 12*b* in the same manner as described in connection with FIGS. 31 and 32. Adhesive strips 110 are identical to strips 100 but just shorter in length. A precured front skin (i.e., radome) 112 is then positioned over the exposed edges of the wall sections 12*a* and 12*b* and pressed onto the wall sections 12*a* and 12*b* to form an assembly 114. Assembly 114 is then vacuum compacted and cured in an autoclave for preferably 2–4 hours at a temperature of preferably about 250° F.–350° F. (121° C.–176° C.), and at a pressure of preferably around 85 psi. The cured assembly 114 is shown in FIG. 37 as antenna aperture 10'. In FIG. 38, the antenna aperture 10 is shown forming a portion of a fuselage 116 of an aircraft 118.

Figure 38A:
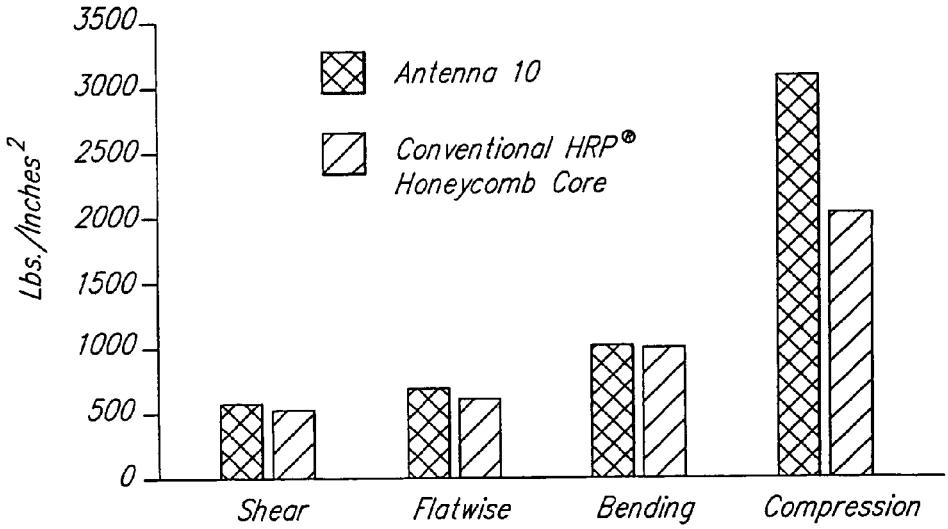
FIG. 38*a* is a graph illustrating the structural strength of the antenna aperture relative to a conventional phenolic core structure.

The structural performance and strength of the antenna aperture 10 is comparable to a composite, HRP® core structure, as illustrated in FIG. 38*a*.

The antenna aperture 10, 10' is able to form a primary aircraft component for a structure such as a commercial aircraft or spacecraft. The antenna aperture 10, 10' can be integrated into a wing, a door, a fuselage or other structural portion of an aircraft, spacecraft or mobile platform. Other potential applications include the antenna aperture 10 forming a structural portion of a marine vessel or land based mobile platform.

Further Alternative Construction of Antenna Aperture

Referring to FIGS. 39–51, an alternative method of constructing each of the wall sections 12 of the antenna aperture 10 will be described. Referring initially to FIG. 39, two plies of resin rich prepreg fabric 130 and 132 are sandwiched between two layers of metallic material 134 and 136. In one preferred form layers 130 and 132 are comprised of Astroquartz® fibers preimpregnated with Cyanate Ester resin. Metallic layers 134 and 136 preferably comprise copper foil having a density of about 0.5 ounce/ft.$^2$ Layers 130–136 are cured flat in an autoclave to produce a rigid, unitary sheet 138 shown in FIG. 40.

Figure 41A:
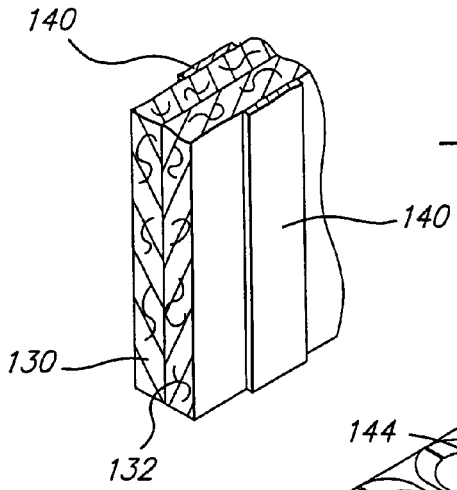
FIG. 41*a* is an end view of a portion of the sheet of FIG. 41 illustrating the electromagnetic radiating elements on opposing surfaces of the sheet.

Referring to FIGS. 41 and 41*a*, portions of the metallic layers 134 and 136 are etched away to form dipole electromagnetic radiating elements 140 that are arranged in adjacent rows on both sides of the sheet 138. Resistors or other electronic components could also be screen printed onto each of the radiating elements 140 at this point if desired.

Figure 42:
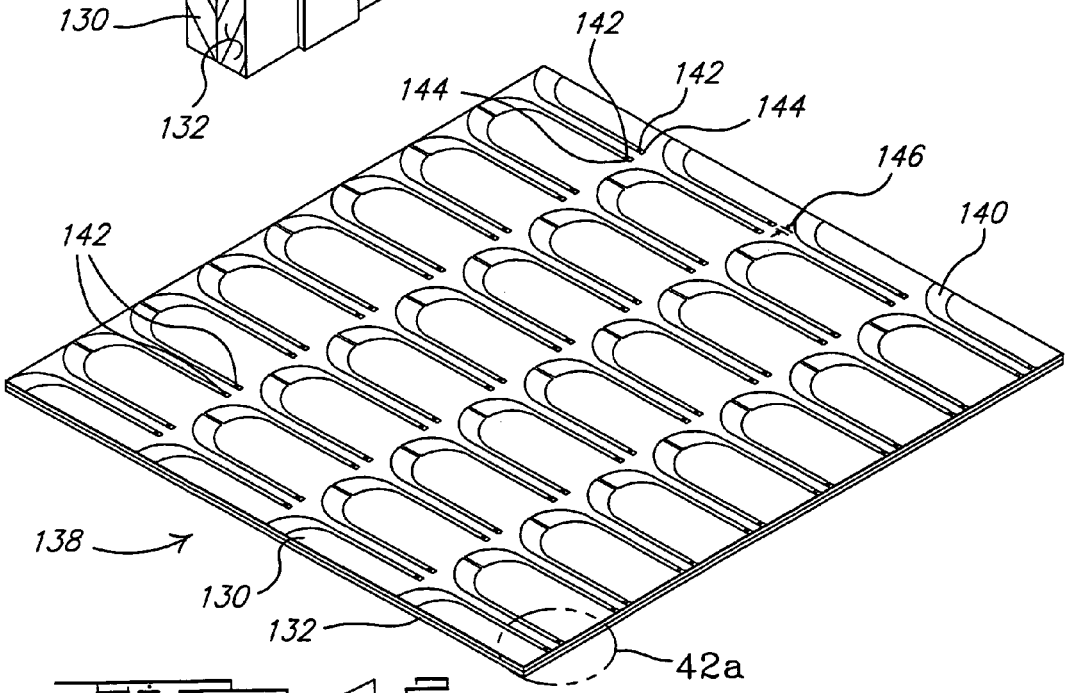
FIG. 42 illustrates the holes and electrically conductive pins formed at each feed portion of each electromagnetic radiating element.
Figure 42A:
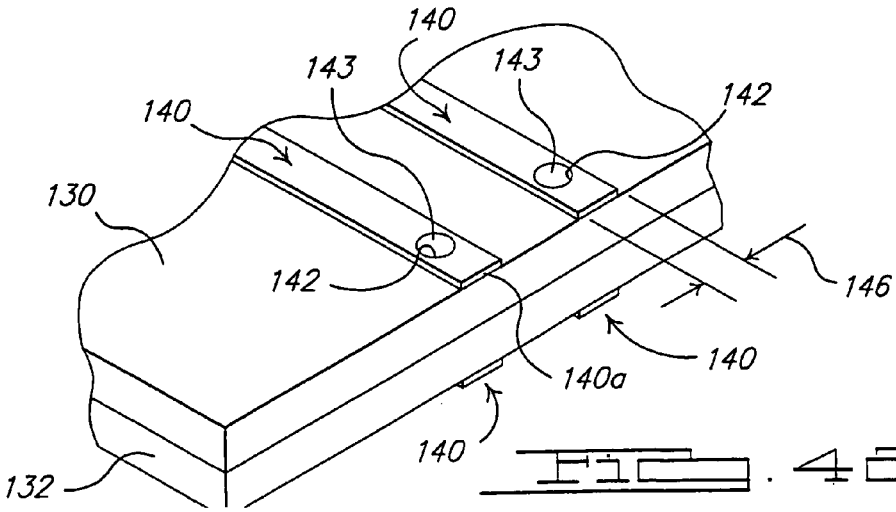
FIG. 42*a* shows in enlarged, perspective fashion the electrically conductive pins that are formed at each feed portion.

Referring to FIGS. 42 and 42*a*, holes 142 are drilled completely through the sheet 138 at feed portions 144 of each radiating element 140. The holes 142 are preferably about 0.030 inch (0.76 mm) in diameter but may vary as needed depending upon the width of the feed portion 144. Preferably, the diameter of each hole 142 is approximately the same or just slightly smaller than the width 146 of each feed portion 144. The holes 142 are further formed closely adjacent the terminal end of each of the feed portions 144 but inboard from an edge 140*a* of each feed portion 144. Each hole 142 is filled with electrically conductive material 143 to form a "pin" or via that electrically couples an opposing, associated pair of radiating elements 140.

Figure 43:
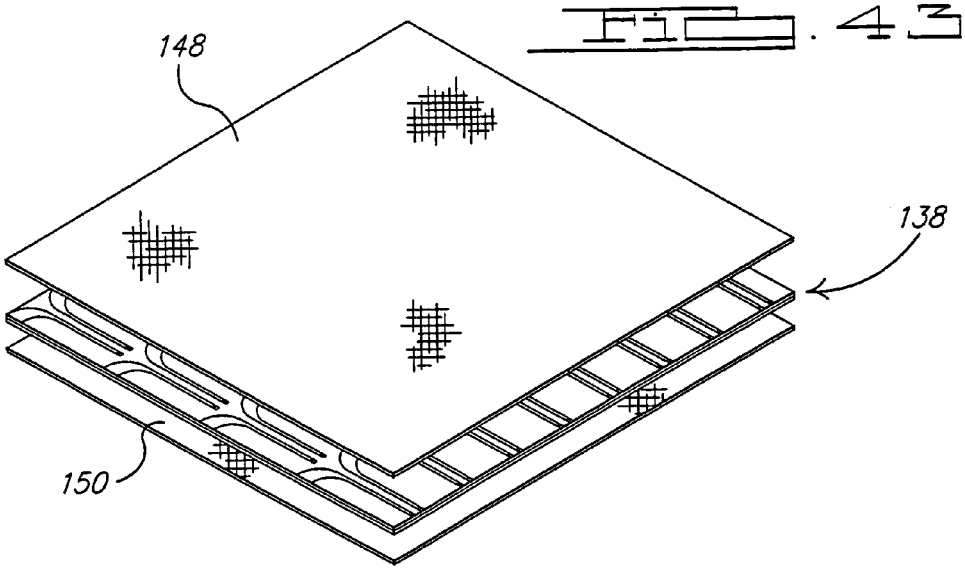
FIG. 43 illustrates the material of FIG. 42 being sandwiched between an additional pair of prepreg fabric plies.

Referring to FIG. 43, sheet 138 is then sandwiched between at least a pair of additional plies of prepreg fabric 148 and 150. Plies 148 and 150 are preferably formed from Astroquartz® fibers impregnated with Cyanate Ester resin. Each of the plies 148 and 150 may vary in thickness but are preferably about 0.005 inch (0.127 mm) in thickness.

Figure 44:
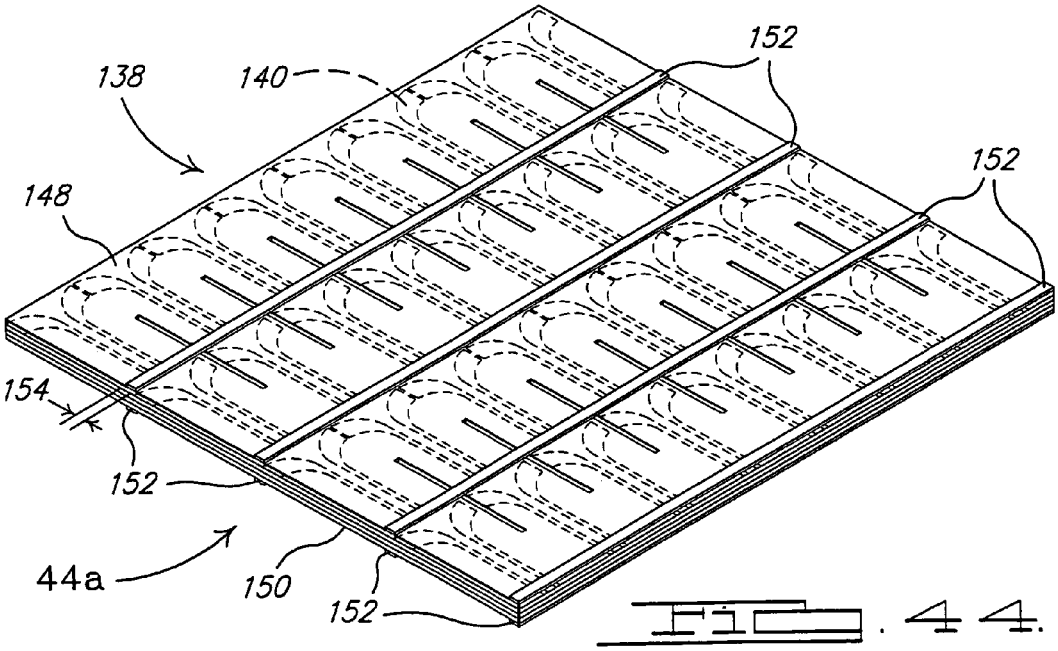
FIG. 44 illustrates metallic strips being placed along the feed portions of each electromagnetic radiating element.
Figure 44A:
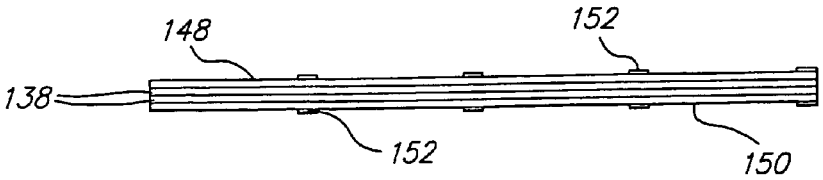
FIG. 44*a* illustrates the metallic strips placed on opposing surfaces of the sheet shown in FIG. 44.

Referring to FIGS. 44 and 44*a*, planar metallic strips 152 are placed along the feed portions 144 of each radiating element 140 on both sides of the sheet 138 to completely cover the holes 142. Metallic strips 152, in one preferred form, comprise copper strips having a thickness of preferably about 0.001 inch (0.0254 mm) and a width 154 of about 0.040 inch (1.02 mm). Again, these dimensions will vary in accordance with the precise shape of the radiating elements 140, and particularly the feed portions 144 of each radiating element. Sheet 138 with the metallic strips 152 is then cured in an autoclave to form an assembly 138'. Autoclave curing is performed at about 85 psi, 250° F.–350° F., for about 2–6 hours.

Figure 45:
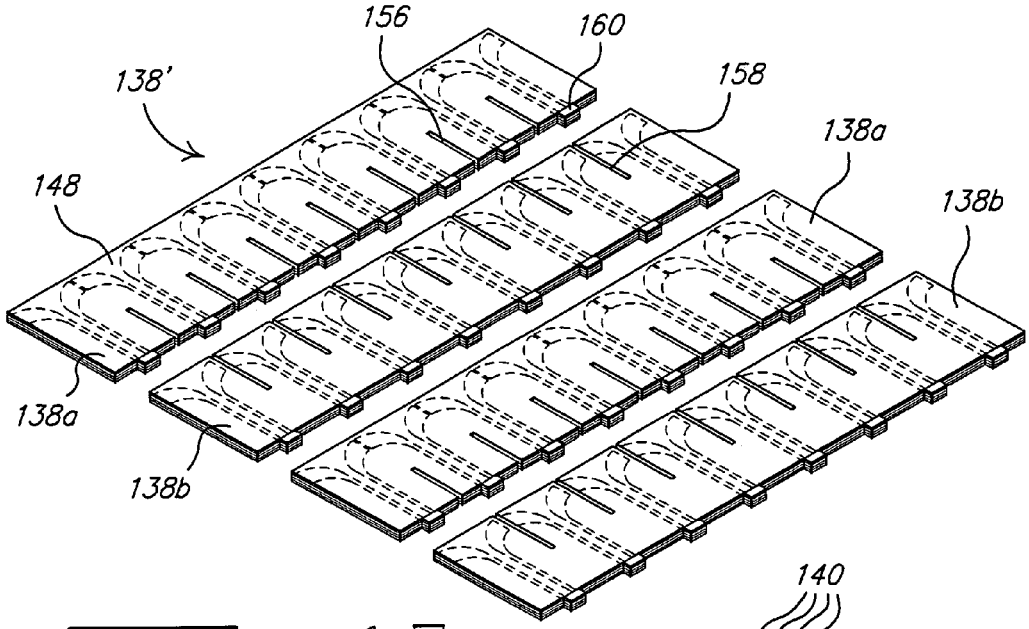
FIG. 45 illustrates the sheet of FIG. 40 cut into a plurality of lengths of material that form wall sections with each wall section being notched such that the feed portions of adjacent radiating elements form a tooth.

Referring to FIG. 45, sheet 138' is then cut into a plurality of lengths that form wall sections 138*a* and 138*b*. Wall sections 138*a* each then are cut to form notches 156, such as by water jet cutting or any other suitable means. Wall sections 138*b* similarly have notches 158 formed therein such as by water jet cutting. The notches 156 and 158 could also be formed before cutting the sheet 138 into sections.

Each of the wall sections 138*a* and 138*b* further have material removed from between the feed portions 144 of the radiating elements 140 so that the feed portions form projecting "teeth" 160. The teeth 160 are used to electrically couple circuit traces of an independent antenna electronics board to the radiating elements 140.

Figure 46:
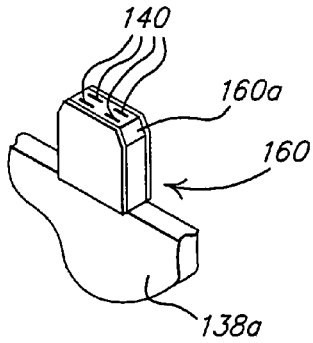
FIG. 46 shows an enlarged perspective view of an alternative preferred form of one tooth in which edges of the tooth are tapered.

Referring to FIG. 46, each tooth 160 could alternatively be formed with tapered edges 160*a* to help ease assembly of the wall sections 138*a* and 138*b*.

Figure 47:
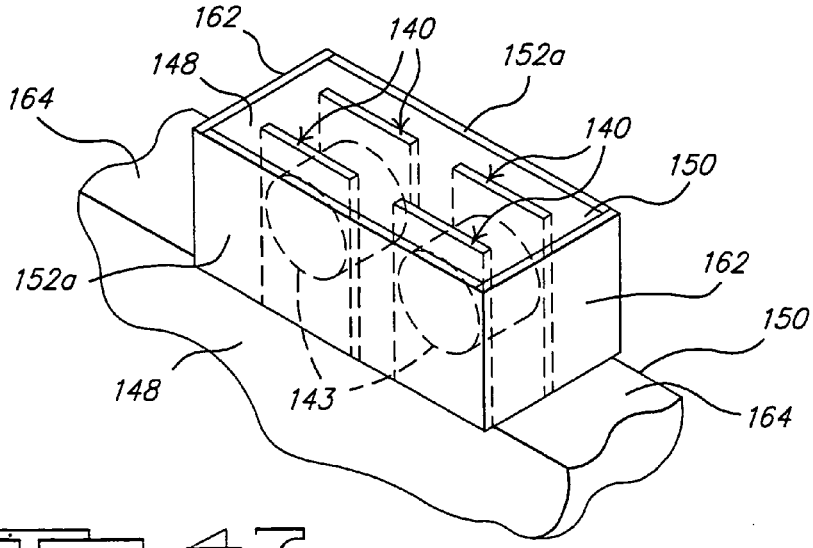
FIG. 47 illustrates an enlarged portion of one of the teeth of the wall section shown in FIG. 45.

Referring to FIG. 47, one tooth 160 of wall section 138*a* is shown. Tooth 160 has resulting copper plating portions 152*a* remaining from the copper strips 152. Side wall portions 162 of each tooth 160, as well as surface portions 164 between adjacent teeth 160, are also preferably plated with a metallic foil, such as copper foil, in a subsequent plating step. All four sidewalls of each tooth 160 are thus covered with a metallic layer that forms a continuous shielding around each tooth 160.

Alternatively, each tooth 160 could be electrically isolated by using a conventional combination of electroless and electrolytic plating. This process would involve covering both sides of each of the wall sections 138*a* and 138*b* with copper foil, which is necessary for the electrolytic plating process. Each wall section 138*a* and 138*b* would be placed in a series of tanks for cleaning, plating, rinsing, etc. The electroless process leaves a very thin layer of copper in the desired areas, in this instance on each of the feed portions 144 of each radiating element 140. The electrolytic process is used to build up the copper thickness in these areas. The process uses an electric current to attract the copper and the solution. After the electrolytic process is complete and the desired amount of copper has been placed at the feed portions 144, each of the wall sections 138*a* and 138*b* are subjected to a second photo etching step which removes the bulk of the copper foil covering the surfaces of wall sections 138*a* and 138*b* so that only copper in the feed areas 144 is left.

Instead of Astroquartz® fibers, stronger structural fibers like graphite fibers, can be used. Thus, graphite fibers, which are significantly structurally stronger than Astroquartz® fibers, but which do not have the electrical isolation qualities of Astroquartz® fibers, can be employed in the back skin. For a given load-bearing capacity that the antenna aperture 10 must meet, a back skin employing graphite fibers will be thinner and lighter than a backskin of equivalent strength formed from Astroquartz®) fibers. The use of graphite fibers to form the backskin therefore allows a lighter antenna aperture 10 to be constructed, when compared to a back skin employing Astroquartz® fibers, for a given load bearing requirement.

Figure 48:
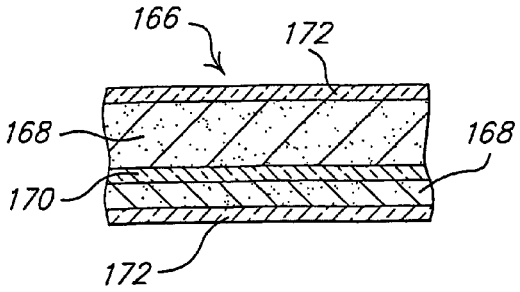
FIG. 48 shows a portion of an alternative preferred construction of a back skin for the antenna aperture.

Referring to FIG. 48, a cross section of a back skin 166 is shown that employs a plurality of plies of graphite fibers 168. A metallic layer 170, preferably formed from copper, is sandwiched between two sections of graphite plies 168. Fiberglass plies 172 are placed on the two graphite plies 168. The assembly is autoclave cured to form a rigid skin panel. Metallic layer 170 acts as a ground plane that is located at an intermediate point of thickness of the back skin 166 that depends on the precise shape of the radiating elements 140 employed, as well as other electrical considerations such as desired dielectric and loss tangent properties.

Figure 49:
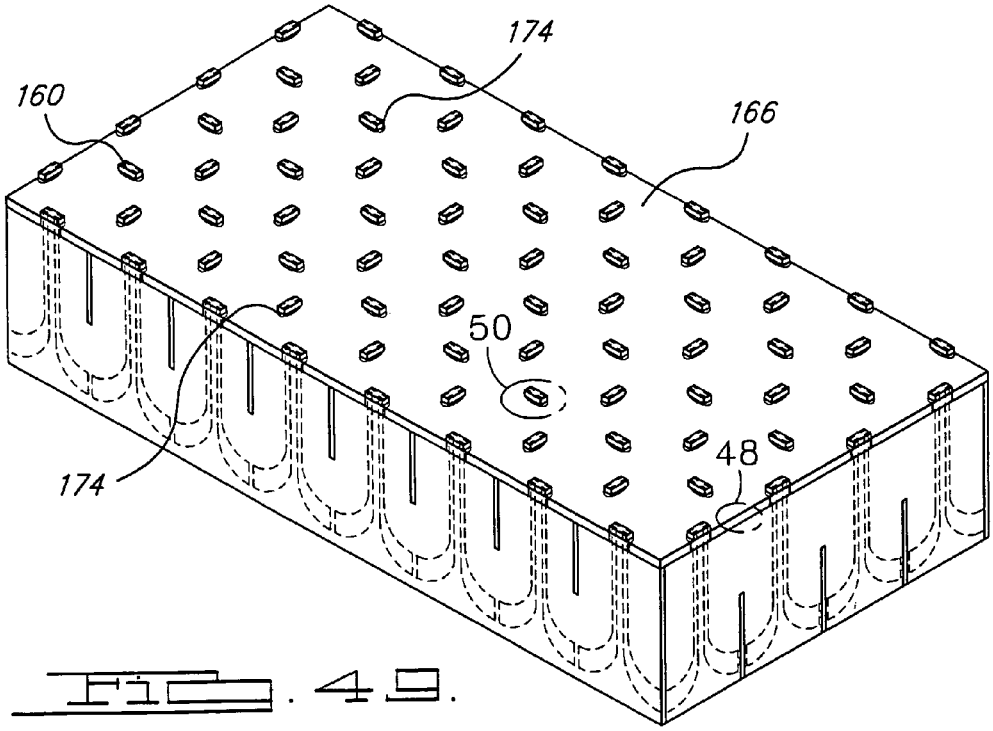
FIG. 49 illustrates an antenna aperture constructed using the back skin of FIG. 48.
Figure 50:
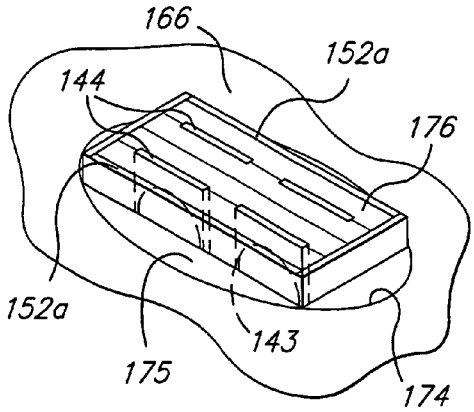
FIG. 50 is a highly enlarged perspective view of one tooth projecting through the back skin of FIG. 49.

Referring to FIG. 49, after the wall portions 138*a* and 138*b* are assembled onto the back skin 166 and autoclave cured as described in connection with FIG. 29, each of the teeth 160 will project slightly outwardly through openings 174 in the back skin 166 as shown in FIG. 50. Each tooth 160 will further be surrounded by epoxy 175 that fills each opening 174.

Figure 51:
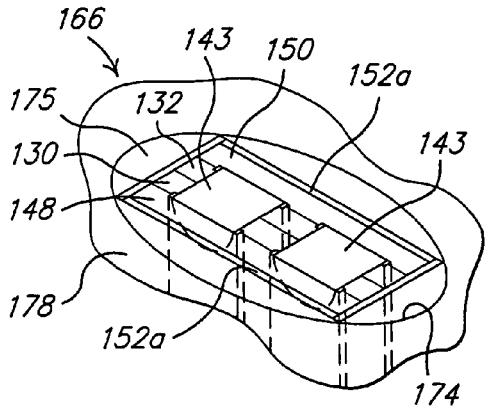
FIG. 51 is an enlarged perspective view of the tooth of FIG. 50 after the tooth has been ground down flush with a surface of the back skin.

The tooth 160 is subsequently sanded so that its upper surface 176 is flush with an upper surface 178 of back skin 166, shown in FIG. 51. The resulting exposed surface is essentially a lower one-half of each metallic pin 143, which is electrically coupling each of the radiating elements 140 on opposite sides of the wall section 138*a* or 138*b*. Thus, metallic pins 143 essentially form electrical contact "pads" which readily enable electrical coupling of external components to the antenna aperture 10.

In mobile platform applications, the antenna aperture 10 also allows the integration of antenna or sensor capabilities without negatively impacting the aerodynamic performance of the mobile platform. The manufacturing method allows apertures of widely varying shapes and sizes to be manufactured as needed to suit specific applications.

Construction of Antenna Aperture Having Conformal Radome

Figure 52:
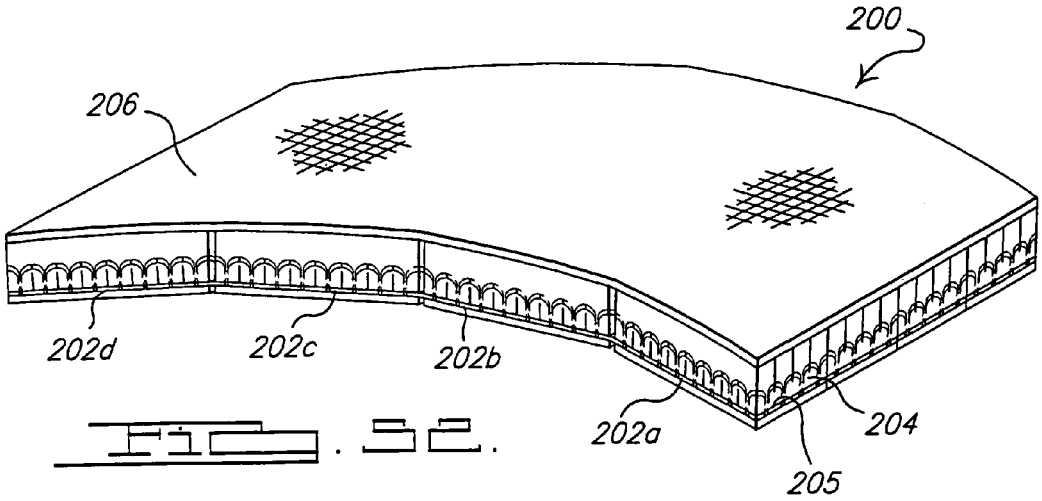
FIG. 52 illustrates a conformal, phased array antenna system in accordance with an alternative preferred embodiment of the present invention.

Referring to FIG. 52, a multi-faceted, conformal, phased-array antenna system 200 is shown in accordance with an alternative preferred embodiment of the present invention. Antenna system 200 generally includes a one-piece, continuous back skin 202 having a plurality of distinct, planar segments 202*a*, 202*b*, 202*c* and 202*d*. Four distinct antenna aperture sections 204*a*–204*d* are secured to a front surface 205 of each of the back skin segments 202*a*–202*d*. Antenna aperture sections 204*a*–204*d* essentially form honeycomb-like core sections for the system 200. A preferably one piece, continuous radome 206 covers all of the antenna aperture sections 204*a*–204*d*. Although four distinct aperture sections are employed, a greater or lesser plurality of aperture sections could be employed. The system 200 thus has a sandwich construction with a plurality of honeycomb-like core sections that is readily able to be integrated into non-linear composite structures.

The conformal antenna system 200 is able to provide a large number of densely packed radiating elements in accordance with a desired mold line to even better enable the antenna system 200 to be integrated into a non-linear structure of a mobile platform, such as a wing, fuselage, door, etc. of an aircraft, spacecraft, or other mobile platform. While the antenna system 200 is especially well suited for applications involving mobile platforms, the ability to manufacture the antenna system 200 with a desired curvature allows the antenna system to be implemented in a wide variety of other applications (possibly even involving on fixed structures) where a stealth, aerodynamics and/or load bearing capability are important considerations for the given application.

Figure 53:
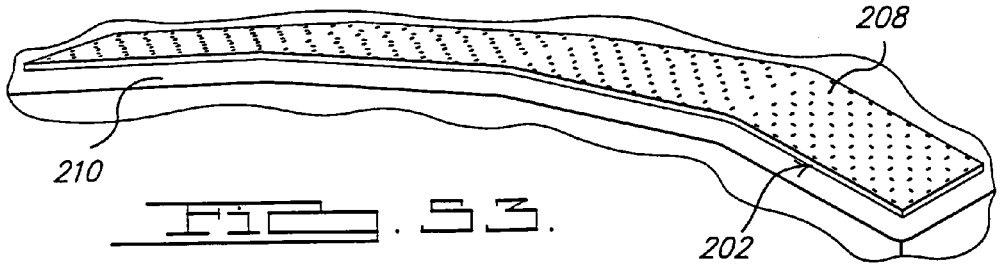
FIG. 53 illustrates a back skin of the antenna system of FIG. 52.

Referring to FIG. 53, the back skin 202 is shown in greater detail. The back skin 202 includes a plurality of openings 208 that will serve to connect with teeth of each of the antenna aperture sections 204*a*–204*d*. By segmenting the back skin 202 into a plurality of planar segments 202*a*–202*d*, printed circuit board assemblies can be easily attached to the back skin 202. The back skin 202 may be constructed from Astroquartz® fibers or in accordance with the construction of the back skin 166 shown in FIG. 48. The back skin 202 is pre-cured to form a rigid structure that is supported on a tool 210 that is shaped in accordance with the contour of the back skin 202.

Figure 54:
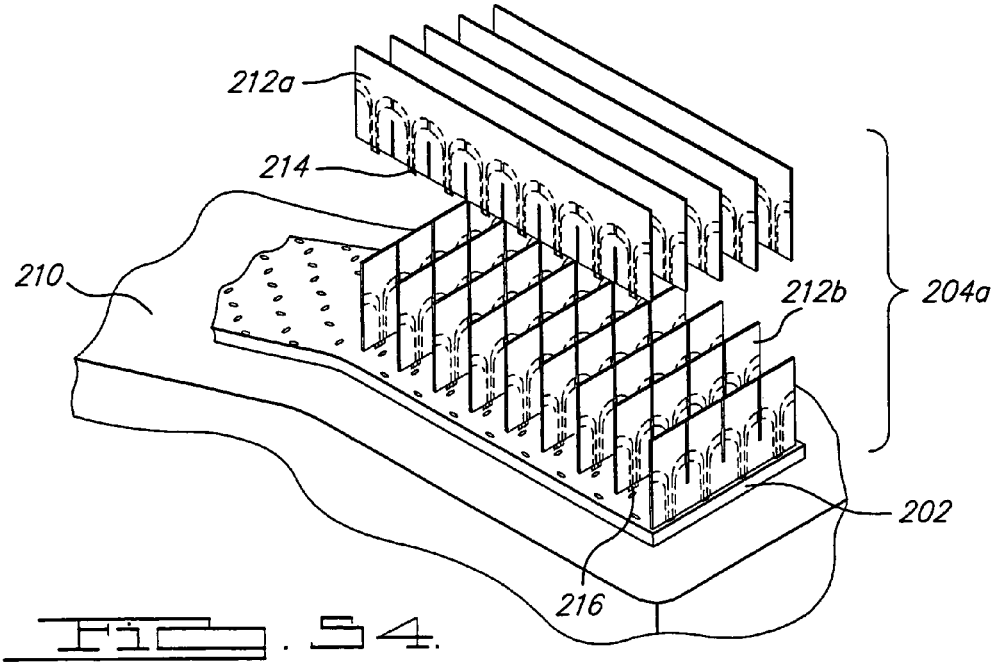
FIG. 54 illustrates the assembly of wall sections forming one particular antenna aperture section of the antenna system of FIG. 52.

Referring to FIG. 54, the construction of antenna aperture section 204*a* is illustrated. The sections 204*a*–204*d* could each be constructed with any of the construction techniques described in the present specification. Thus, the assembly of wall sections 212*a* and 212*b* onto the back skin 202 is intended merely to illustrate one suitable method of assembly. In this example, wall sections 212*a* and 212*b* are assembled using the construction techniques described in connection with FIGS. 31–37. Teeth 214 of wall sections 212*a* are inserted into holes 208 to secure the wall sections 212*a* to the back skin 202. Wall sections 212*b* having teeth 216 are then secured to the back skin 202 in interlocking fashion with wall sections 212*a*. During this process the entire back skin 202 is supported on the tool 210. Each of the antenna aperture sections 204*a*–204*d* are assembled in a manner shown in FIG. 54.

Figures 55, 56, 57:
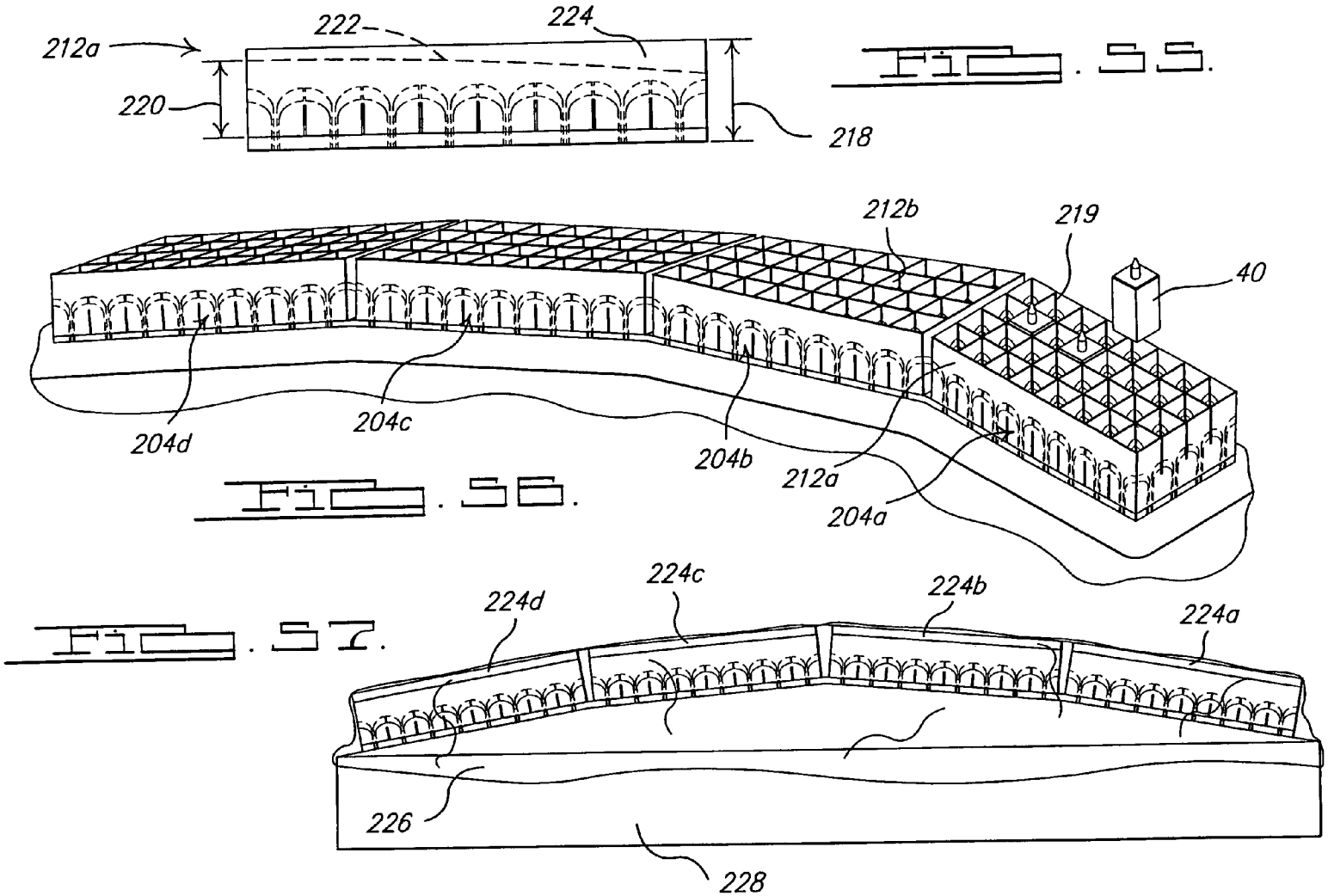
FIG. 55 is a planar view of one wall section of the antenna system of FIG. 54 illustrating the area that will be removed in a subsequent manufacturing step to form a desired contour for the one wall section.
FIG. 56 is a perspective view of each of the four antenna aperture sections assembled onto a common back skin with metallic blocks being inserted into each of the cells formed by the intersecting wall sections.
FIG. 57 illustrates the subassembly of FIG. 56 being vacuum compacted.

Referring to FIG. 55, one wall portion 212*a* is illustrated. Each of wall portions 212*a* of antenna module 204*a* have a height 218 that is at least as great, and preferably just slightly greater than, a height 220 of the highest point that the antenna aperture section 204*a* will have once the desired contour is formed for the antenna system 200. A portion of the desired contour is indicated by dashed line 222. Portion 224 above the dashed line 222 will be removed during a subsequent manufacturing operation, thus leaving only a portion of the wall section 212*a* lying beneath the dashed line 222. For simplicity in manufacturing, it is intended that the wall sections 212*a* and 212*b* of each of antenna modules 204*a*–204*d* will initially have the same overall height. However, depending upon the contour desired, it may be possible to form certain ones of the aperture sections 204*a*–204*d* with an overall height that is slightly different to reduce the amount of wasted material that will be incurred during subsequent machining of the wall portions to form the desired contour.

Referring to FIG. 56, once all of the aperture sections 204*a*–204*d* are assembled onto the back skin, then beads of adhesive 219 are placed at the intersecting areas of each of the wall portions 212*a* and 212*b*. Metallic blocks 40 are then inserted into the cells formed by the wall portions 212*a* and 212*b*.

Referring to FIG. 57, metal plates 224*a*–224*d* are then placed over each of the aperture sections 204*a*–204*d*. The entire assembly is covered with a vacuum bag 226 and rests on a suitably shaped tool 228. The assembly is vacuum compacted and then allowed to cure in an oven or autoclave.

Figure 58:
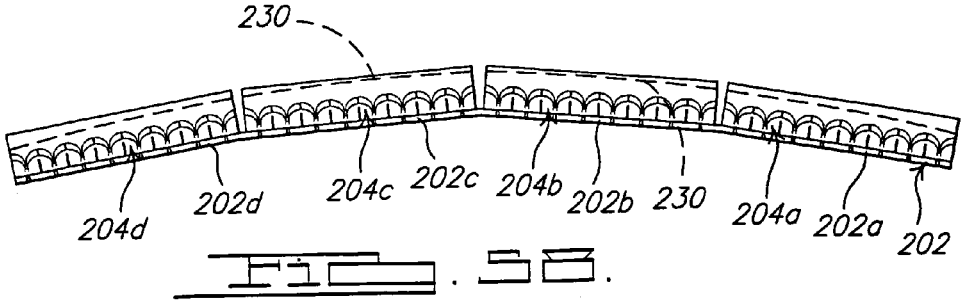
FIG. 58 illustrates the compacted and cured assembly of FIG. 56 with a dashed line indicating the contour that the antenna modules will be machined to meet.

In FIG. 58, the cured antenna aperture sections 204*a*–204*d* and back skin 202 are illustrated after the metallic blocks 40 have been removed. Dashed line 230 indicates a contour line that an upper edge surface of the aperture sections 204*a*–204*d* are then machined along to produce the desired contour.

Figure 59:
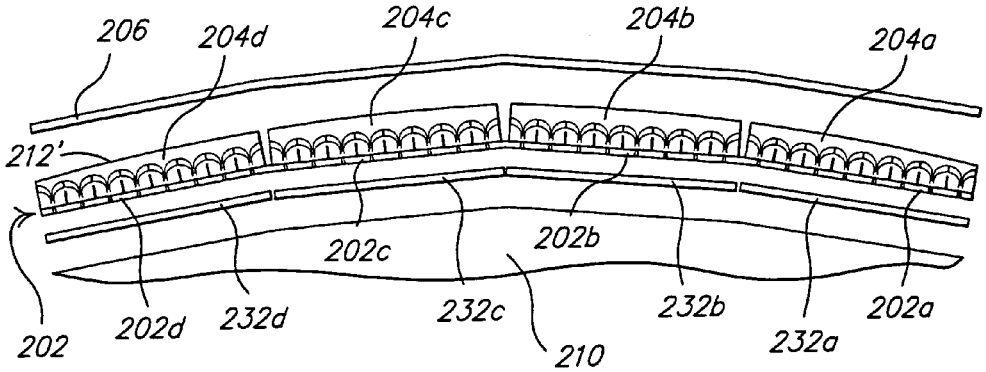
FIG. 59 is an exploded perspective illustration of the plurality of antenna electronics circuit boards and the radome that are secured to the antenna aperture sections to form the conformal antenna system.

Referring to FIG. 59, the one piece, pre-cured radome 206 is then aligned over the aperture sections 204*a*–204*d* and bonded thereto during subsequent compaction and curing steps using tool 210. Surface 212' now has the contour that is needed to match the mold line of the structure into which the antenna system 200 will be installed.

Figure 60:
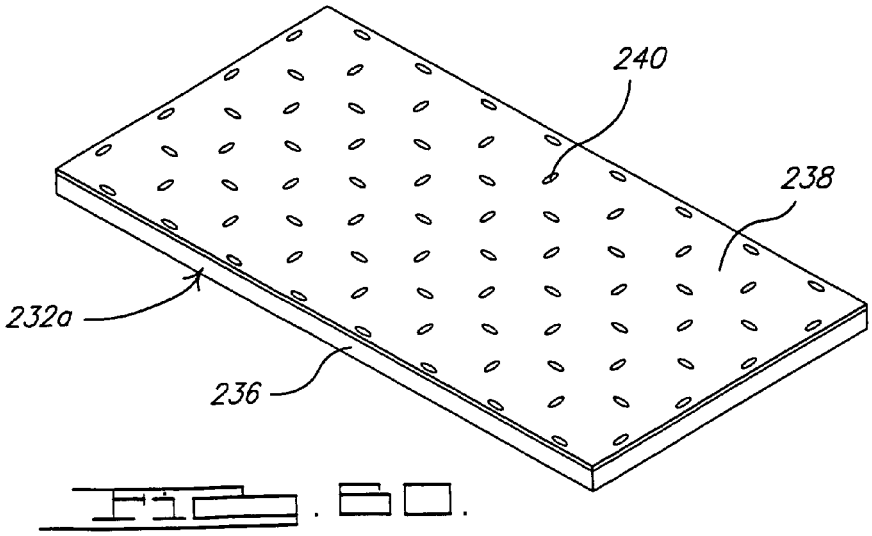
FIG. 60 is an enlarged perspective view of an antenna electronics printed circuit board illustrating a section of adhesive film applied thereto with portions of the film being removed to form holes.
Figure 61:
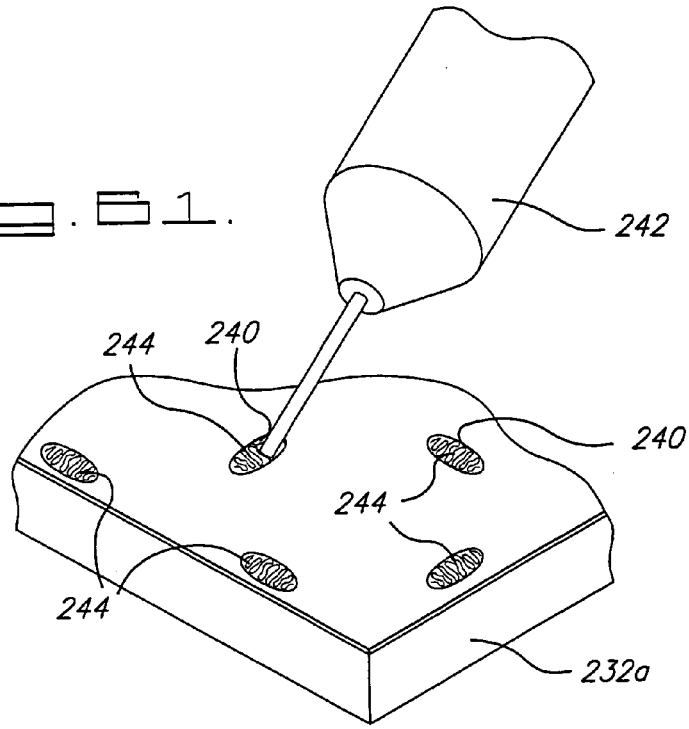
FIG. 61 is a highly enlarged portion of one corner of the circuit board of FIG. 60 illustrating electrically conductive epoxy being placed in each of the holes in the adhesive film.

With reference to FIGS. 60 and 61, the construction of one antenna electronics circuit board 232*a* is shown in greater detail. In FIG. 60, circuit board 232*a* includes a substrate 236 upon which an adhesive film 238 is applied. The adhesive film 238 may comprise one ply of 0.0025" (0.0635mm) thick, Structural™ bonding tape available from 3M Corp., or possibly even a plurality of beads of suitable epoxy. If adhesive film 238 is employed, a plurality of circular or elliptical openings 240 are produced by removing portions of the adhesive film 238. The openings 240 are preferably formed by punching out an elliptical or circular portion after the adhesive film 238 has been applied to the substrate 236. The openings 240 are aligned with the teeth 214 and 216 of each of the wall sections 212*a* and 212*b*. The thickness of adhesive film 238 may vary but is preferably about 0.0025 inch (0.0635 mm).

In FIG. 61, a syringe 242 or other suitable tool is used to fill the holes 240 with an electrically conductive epoxy 244. The electrically conductive epoxy 244 provides an electrical coupling between the teeth 214 and 216 on each of the wall sections 212*a* and 212*b* and circuit traces (not shown) on circuit board 232*a*.

The bonded and cured assembly of FIG. 59 is then bonded to the circuit boards 232*a*–232*d*. A suitable tooling jig with alignment pins is used to precisely locate the circuit boards 232*a*–232*d* with the teeth 214 and 26 of each of the aperture sections 204*a*–204*d*. The assembled components are placed on a heated press. Curing is performed at a temperature of preferably about 225° F.–250° F. (107° C.–131° C.) at a pressure of about 20 psi minimum for about 90 minutes.

Figure 62:
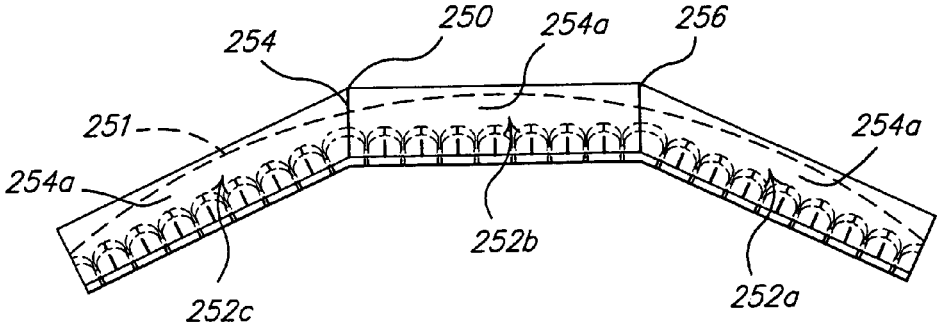
FIG. 62 is an end view of an alternative preferred embodiment of the antenna system of the present invention in which wall portions that are used to form each of the antenna aperture sections are shaped to minimize the areas of the gaps between adjacent edges of the modules.

Referring to FIG. 62, depending upon the degree of curvature that the contour at the antenna system 200 needs to meet, the small areas inbetween adjacent antenna modules 204*a*–204*d* may be too large for the load bearing requirements that the antenna system 200 is required to meet. In this event, the wall portions 212*a* and 212*b* can be pre-formed with a desired shape intended to reduce the size of the gaps formed between the aperture sections 204*a*–204*d*. An example of this is shown in FIG. 62 in which three aperture sections 252*a*, 252*b* and 252*c* will be required to form a more significant curvature than illustrated in FIG. 52. In this instance, wall sections 254*a* of each aperture section 252*a*–252*c* are formed such that the edge that is adjacent center module 252*b* significantly reduces the gaps 256 that are present on opposite sides of antenna module 252. In practice, the wall sections 212*a* and/or 212*b* can also be formed with dissimilar edge contours to reduce the area of the gaps that would otherwise be present between the edges of adjacent aperture sections 204*a*–204*d*.

By forming a plurality of distinct aperture sections, modular antenna systems of widely varying scales and shapes can be constructed to meet the needs of specific applications.

CONCLUSION

The various preferred embodiments all provide an antenna aperture having a honeycomb-like core sandwiched between a pair of panels that forms a construction enabling the aperture to be readily integrated into composite structures to form a load bearing portion of the composite structure. The preferred embodiments do not add significant weight beyond what would otherwise be present with conventional honeycomb-like core, sandwich-like construction techniques, and yet provides an antenna capability.

While various preferred embodiments have been described, those skilled in the art will recognize modifications or variations which might be made without departing from the inventive concept. The examples illustrate the invention and are not intended to limit it. Therefore, the description and claims should be interpreted liberally with only such limitation as is necessary in view of the pertinent prior art.

What is claimed is:

1. A conformal, load bearing antenna apparatus, comprising:

an antenna aperture having a honeycomb core structure including a plurality of intersecting wall portions, said wall sections having a pair of layers with at least one of said layers being a composite material layer;

a plurality of electromagnetic radiating elements supported on said wall portions and embedded between said layers;

said honeycomb core structure having a conformal surface portion selected to conform with a surface contour of a structure into which said apparatus is integrated; and a radome secured to said conformal surface portion of said honeycomb structure, said radome having a contour selected to match said conformal portion.

2. The apparatus of claim 1, wherein the honeycomb core structure has a planar portion, and wherein said apparatus further comprises a planar back skin secured to said planar portion of said honeycomb core structure.

3. The apparatus of claim 1, further comprising an antenna electronics printed circuit board assembly secured to said back skin and in electrical communication with said electromagnetic radiating elements.

4. The apparatus of claim 1, wherein said conformal surface portion is integrally formed with said honeycomb core structure.

5. The apparatus of claim 1, wherein said electromagnetic radiating elements comprise dipole radiating elements.

6. A multi-section, conformal, load bearing antenna apparatus, comprising:

a plurality of antenna aperture sections, each of said antenna aperture sections including:

a honeycomb core structure having a plurality of intersecting wall portions defining a planar surface along first edges thereof and a conformal surface along second edges thereof, each of said wall portions having first and second layers, with at least one of said layers forming a composite layer;

a plurality of electromagnetic radiating elements supported on said wall portions and sandwiched between said layers;

a back skin having a plurality of contiguous planar segments, said planar segments being attached to said planar surfaces of said antenna apertures sections, said conformal back skin forming a contour that approximates a contour of said conformal surface of said honeycomb core structure; and a conformal radome secured to said conformal surface of each of said antenna aperture sections.

7. The apparatus of claim 6, wherein said back skin comprises a single panel of composite material.

8. The apparatus of claim 6, further comprising a plurality of antenna electronics printed circuit boards secured to said planar segments of said back skin and in electrical communication with said electromagnetic radiating elements of each of said antenna apertures.

9. The apparatus of claim 6, wherein said conformal radome comprises a single length of composite material draped over said conformal surface of each said honeycomb core structure of each said antenna aperture section.

10. The apparatus of claim 6, wherein said electromagnetic radiating elements comprise dipole radiating elements.

11. A multi-faceted, conformal, load bearing, phased array antenna system, comprising:

a plurality of independent antenna aperture sections each having a honeycomb core structure supporting a plurality of electromagnetic radiating elements, and a conformal surface portion and an opposing planar surface portion, said honeycomb core structure having a plurality of wall portions that each include a plurality of layers of material, with said electromagnetic radiating elements sandwiched between said layers;

a multi-faceted back skin having a plurality of contiguous planar sections secured to said planar surface portions of said honeycomb core structures; and a conformal radome secured to said conformal surface portion of each of said honeycomb core structures.

12. The antenna system of claim 11, further comprising a plurality of antenna electronics printed wiring boards, with each said wiring board being secured to an associated one of said planar sections of said multi-faceted back skin and being in electrical communication with said electromagnetic radiating elements of an associated one of said antenna aperture sections.

13. The antenna system of claim 11, wherein said conformal radome comprises a single piece of composite fabric draped over said conformal surface portion of each of said honeycomb core structures.

14. The antenna system of claim 11, wherein said multi-faceted back skin forms a contour generally in accordance with a contour collectively formed by said conformal surface portions of said antenna aperture sections.

15. The antenna system of claim 11, wherein said electromagnetic radiating elements comprise dipole radiating elements.

16. A method for forming a conformal, load bearing antenna aperture, comprising:

forming a honeycomb core structure having a plurality of wall portions of a predetermined strength to act as a load bearing component of a structure, said wall portions including electromagnetic radiating elements embedded between layers of each of said wall portions;

further forming said honeycomb core structure such that said wall portions collectively define first and second opposing surfaces, said first surface forming a conformal surface selected to conform to a surface contour of said structure;

securing a back skin to said second surface of said honeycomb core structure; and securing a conformal radome to said first surface of said honeycomb core structure, said radome having a contour selected to conform to a contour of said first surface.

17. The method of claim 16, further comprising forming said back skin as a planar panel from a single portion of composite material.

18. The method of claim 16, further comprising securing an antenna electronics printed wiring board to said back skin.

19. The method of claim 16, wherein forming said honeycomb core structure with first and second opposing surfaces comprises initially forming said honeycomb core structure with first and second opposing surfaces extending parallel to one another, and then removing a portion of said first surface in a subsequent manufacturing step to form said conformal surface.

20. A method for forming a conformal, load bearing, phased array antenna system, the method comprising:

forming a plurality of antenna apertures each having a plurality of wall portions each defining a honeycomb core structure, said wall portions each including a plurality of layers of material, with at least one of said layers including a composite material, sandwiching electromagnetic radiating elements between said layers of material;

further forming said honeycomb core structures each with first and second opposing surfaces, with said first surfaces each forming a conformal surface;

forming a multi-faceted back skin having a plurality of contiguous planar segments;

securing said second surfaces of said honeycomb core structures to said planar segments; and securing a conformal radome to said conformal surfaces of said honeycomb core structures.

21. The method of claim 20, further comprising forming said back skin from a single portion of composite material.

22. The method of claim 20, further comprising securing an independent antenna electronics printed wiring board to each of said planar segments of said back skin.

23. The method of claim 20, further comprising forming said radome from a single portion of composite fabric.

24. The method of claim 20, wherein forming said antenna apertures comprises initially forming said honeycomb core structures such that said first and second opposing surfaces of each said aperture are parallel, and then removing material from said first surface in a subsequent manufacturing operation to form said conformal surface for each said aperture.

* * * * *